US005932854A

United States Patent [19]

Umemura

[11] Patent Number: 5,932,854

[45] Date of Patent: Aug. 3, 1999

[54] MULTIPLE PUSH-BUTTON ASSEMBLY WITH INTERLOCKING MECHANISM

[75] Inventor: Heihachiro Umemura, Sakai, Japan

[73] Assignee: Shinkoh Electric Co., Ltd., Osaka, Japan

[21] Appl. No.: 09/058,158

[22] Filed: Apr. 10, 1998

[30] Foreign Application Priority Data

Apr. 14, 1997 [JP] Japan ..... 9-113496
Feb. 9, 1998 [JP] Japan ..... 10-044483

[51] Int. Cl.[6] ..... H01H 9/20; H01H 9/26

[52] U.S. Cl. ..... 200/5 B; 200/5 E; 200/50.36; 200/50.33; 74/483 PB

[58] Field of Search ..... 200/5 B, 5 C, 200/5 D, 5 E, 50.32, 50.33, 50.36; 74/483 PB; 307/127

[56] References Cited

U.S. PATENT DOCUMENTS 5,045,647 9/1991 Kato ..... 200/5 E
5,382,836 1/1995 Umemura ..... 307/127
5,473,203 12/1995 Umemura ..... 307/127
5,576,525 11/1996 Umemura ..... 200/520 X
5,646,382 7/1997 Moriya ..... 200/50.33

*Primary Examiner*—J. R. Scott
*Attorney, Agent, or Firm*—Wenderoth, Lind & Ponack, L.L.P.

[57] ABSTRACT

An interlocking device for a push-button switch in compact size and with a mechanically simple construction, capable of achieving the interlocking of a push-button switch having a pair of push buttons facing each other and being downwardly movable by pressing in multiple stages, while sufficiently securing the stroke in each stage of the push buttons. The interlocking device is comprised of a first interlocking member and a second interlocking member. The first interlocking member being inserted, at both ends, in the two push buttons respectively, forming a projection at the bottom and being disposed on the switch body swingably and in a way to be movable up and down through a spindle. The second interlocking member being extended, at both ends, to a lower position of the two push buttons respectively, forming, at the top, a projection which comes in contact with the projection formed on the first interlocking member and being swingably provided on the switch body through a spindle.

8 Claims, 23 Drawing Sheets

Fig. 1 ( a )
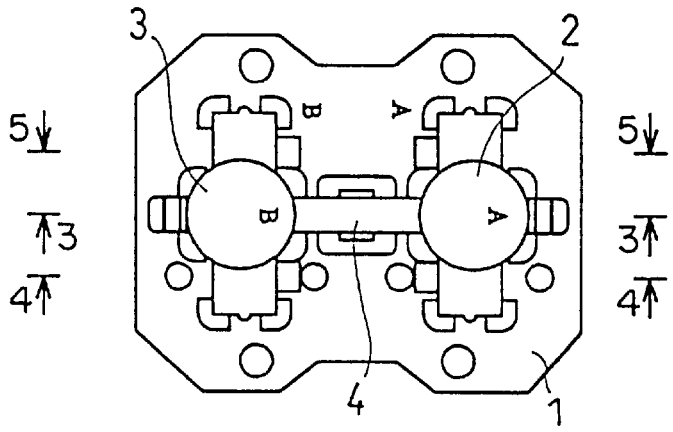
Fig. 1 ( d )
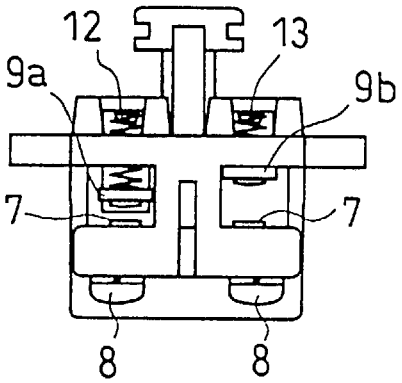
Fig. 1 ( b )
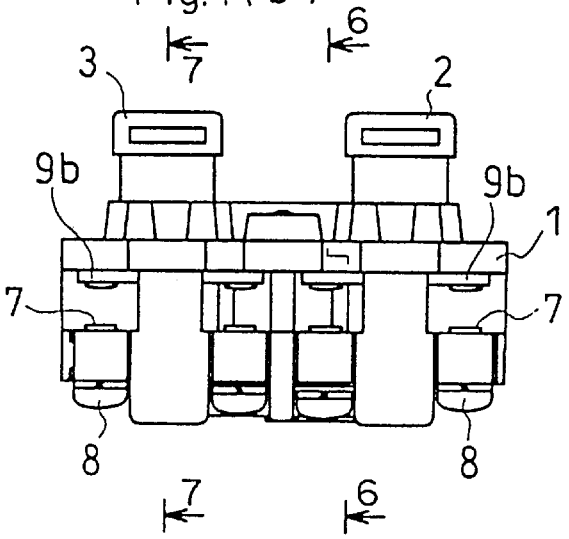
Fig. 1 ( e )
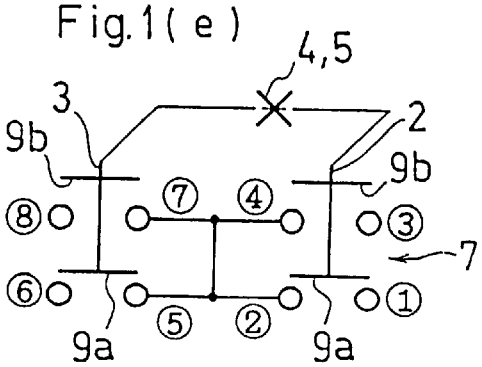
Fig. 1 ( c )
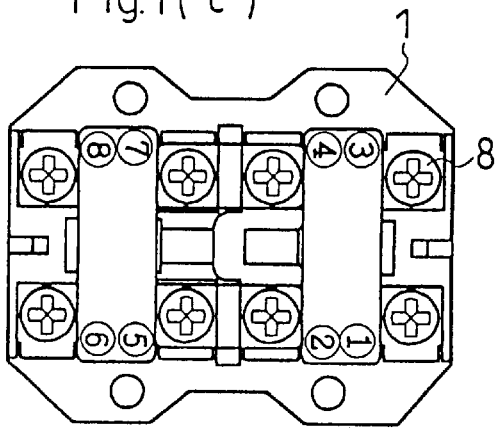

Fig. 27( a )
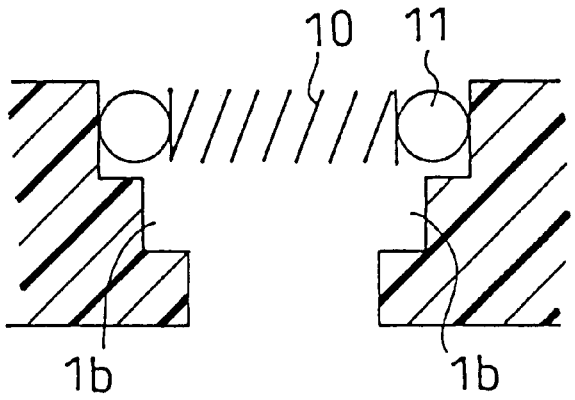
Fig. 27( b )
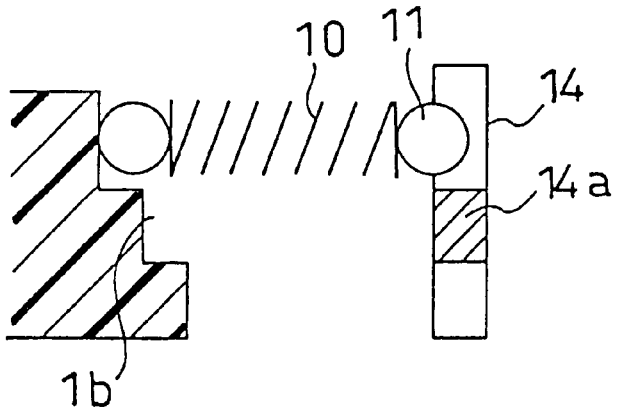
Fig. 27( c )
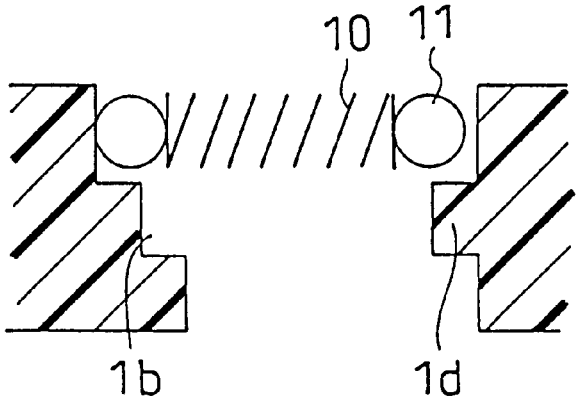

MULTIPLE PUSH-BUTTON ASSEMBLY WITH INTERLOCKING MECHANISM

BACKGROUND OF THE INVENTION

The present invention relates to an interlocking device for a push-button switch used for the operation of cranes and hoists, for example. More specifically, it relates to an interlocking device of a push-button switch including a fixed contact on the switch body provided with two push buttons, having a mobile contact, which face each other. The push buttons being downwardly movable by pressing in multiple stages.

On a conventional push-button switch used for the operation of cranes and hoists, an interlocking member for the push button is swingably provided with approximately the middle position of two push buttons, provided face to face with each other in the proximity of the push-button switch. The interlocking member acts as a fulcrum, to prevent simultaneous pressing down of the two push buttons, so that the operator may not press down the two push buttons at the same time by mistake, causing reckless run or other trouble of the equipment. See U.S. Pat. No. 5,045,647.

Also, when the conventional interlocking device for a push-button switch is applied a push-button switch having a pair of push buttons facing each other and being downwardly movable by pressing in multiple stages, or in two stages for example, a problem was that to enable pressing down in two stages of either push button while preventing simultaneous pressing down of the two push buttons, it was impossible to maintain a large degree of freedom of a relative operating range between the two push buttons and the interlocking member due to the structure of this interlocking device. Thus it was difficult to maintain a sufficient stroke in each stage of the push buttons and, even when a sufficient stroke was maintained in each stage, a drop in the operability of the push buttons existed in both cases.

SUMMARY OF THE INVENTION

The object of the present invention is to provide, in view of the problems of the conventional interlocking devices for push-button switches, a compact-sized interlocking device for push-button switches with a mechanically simple construction, capable of interlocking with a push-button switch having a pair of push buttons facing each other and being downwardly movable by pressing in multiple stages, while sufficiently securing the stroke in each push button stage.

To achieve this object, the interlocking device for push-button switches according to the present invention is an interlocking push-button switch realized by providing, on a switch body with a fixed contact, two push buttons, with a mobile contact, located in a way that they face each other and are downwardly movable by being pressed in multiple stages. The interlocking member is comprised of a first interlocking member and a second interlocking member, with the first interlocking member being inserted, at both ends, in the two respective push buttons, thus forming a projection at the bottom. The first and second interlocking members being swingably disposed on the switch body in such a way that they can move up and down through a spindle, with the second interlocking member being extended, at both ends, to a lower position of the two respective push buttons, forming, at the top, a projection which comes in contact with the projection formed by the first interlocking member.

This interlocking device for push-button switches, designed to interlock with a push-button switch having a pair of push buttons facing each other and being downwardly movable by pressing in multiple stages, and which is comprised of a first interlocking member swingably disposed on the switch body and in a way to be movable up and down through a spindle, and a second interlocking member swingably provided on the switch body through a spindle, can secure a relatively large degree of freedom of an operating range between the two push buttons and both of the interlocking members, and can therefore secure a sufficient stroke in each push button stage.

Moreover, such an interlocking device for push-button switches, can not only improve the operability of push-button switches during times of normal push button press-down operation, without application of any large deforming force to either interlocking member, but can also improve the durability of push-button switches containing interlocking members which are often made of synthetic resin material.

In this case, this interlocking device for push-button switches, may be constructed in such a way that only the first interlocking member swings when the push button is pressed down one stage.

This makes it possible to improve the durability of the apparatus by simplifying the motions of the interlocking device.

Furthermore, this interlocking device for push-button switches, may also be constructed in such a way as to provide a spring for controlling the posture of the second interlocking member between the push button and the second interlocking member.

This makes it possible to swing the second interlocking member through a spring, when the push button is pressed down, before the second interlocking member is pushed down, thus ensuring a smooth swinging motion of the second interlocking member.

BRIEF DESCRIPTION OF THE DRAWINGS

FIG. 1 shows a push-button switch which includes the interlocking device for a push-button switch according to the present invention (first embodiment), FIG. 1(*a*) being a plan view, FIG. 1(*b*) a front elevation, FIG. 1(*c*) a bottom view, FIG. 1(*d*) a side view, and FIG. 1(*e*) a circuit diagram.

Figure 12:
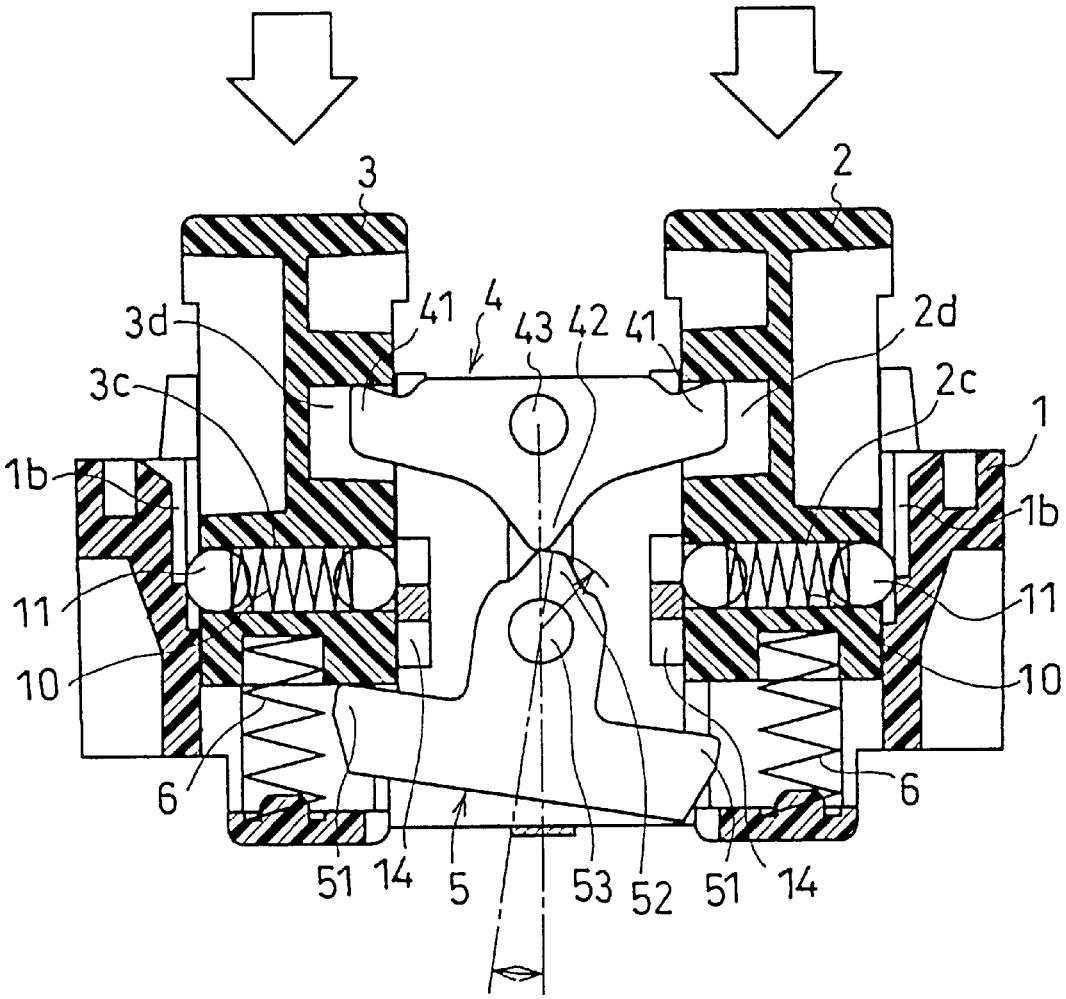

FIG. 12 is an explanatory drawing of the working state of the push-button switch in FIG. 1 (sectional view at line 3—3 of FIG. 1(*a*)), showing the state in which the two push buttons are pressed down simultaneously. The state where the second interlocking member is inclined to the extreme right.

Figure 13:
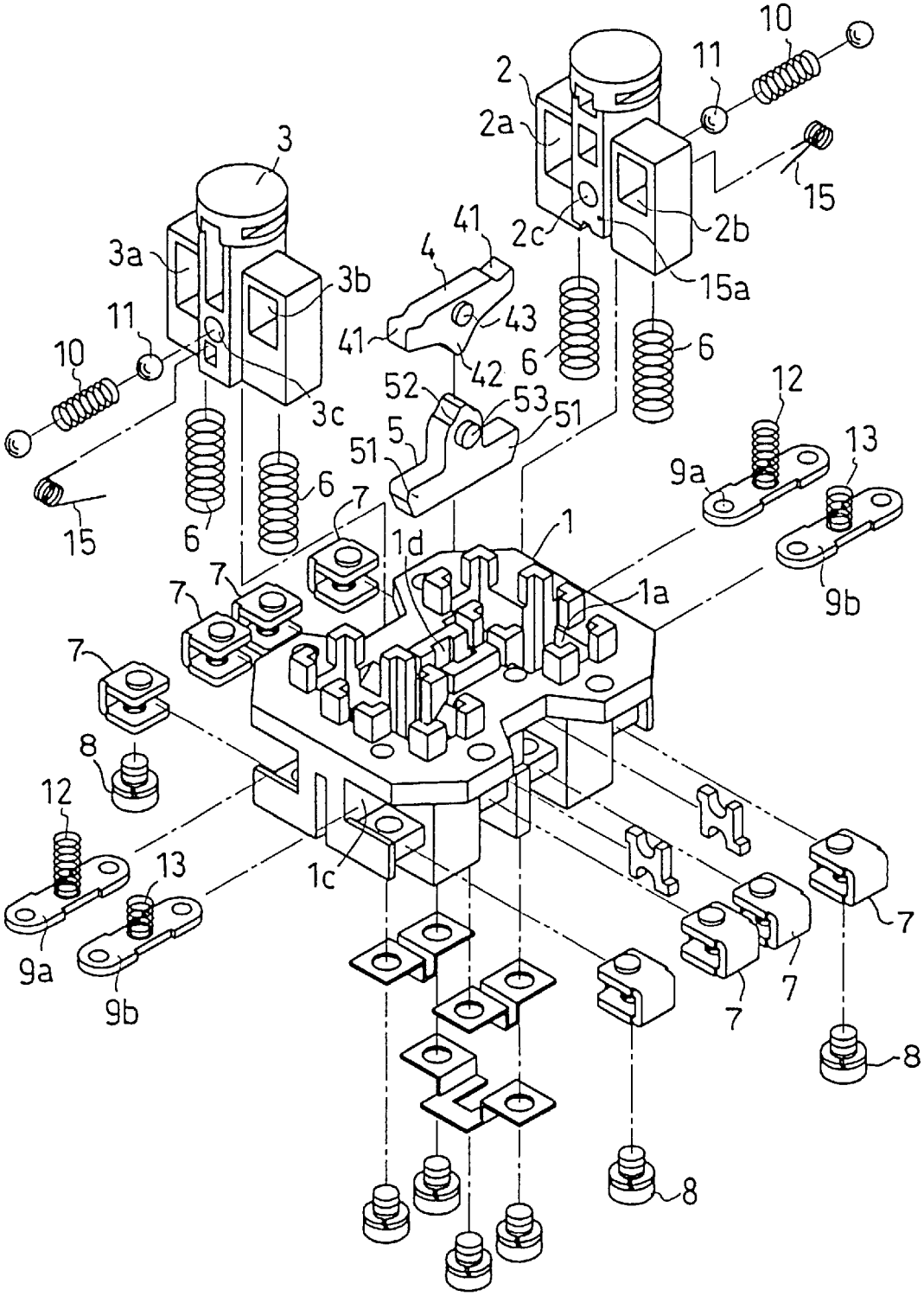

FIG. 13 is an exploded perspective view of a push-button switch which includes the interlocking device for a push-button switch according to the present invention and is a first variant of first embodiment.

Figure 14:
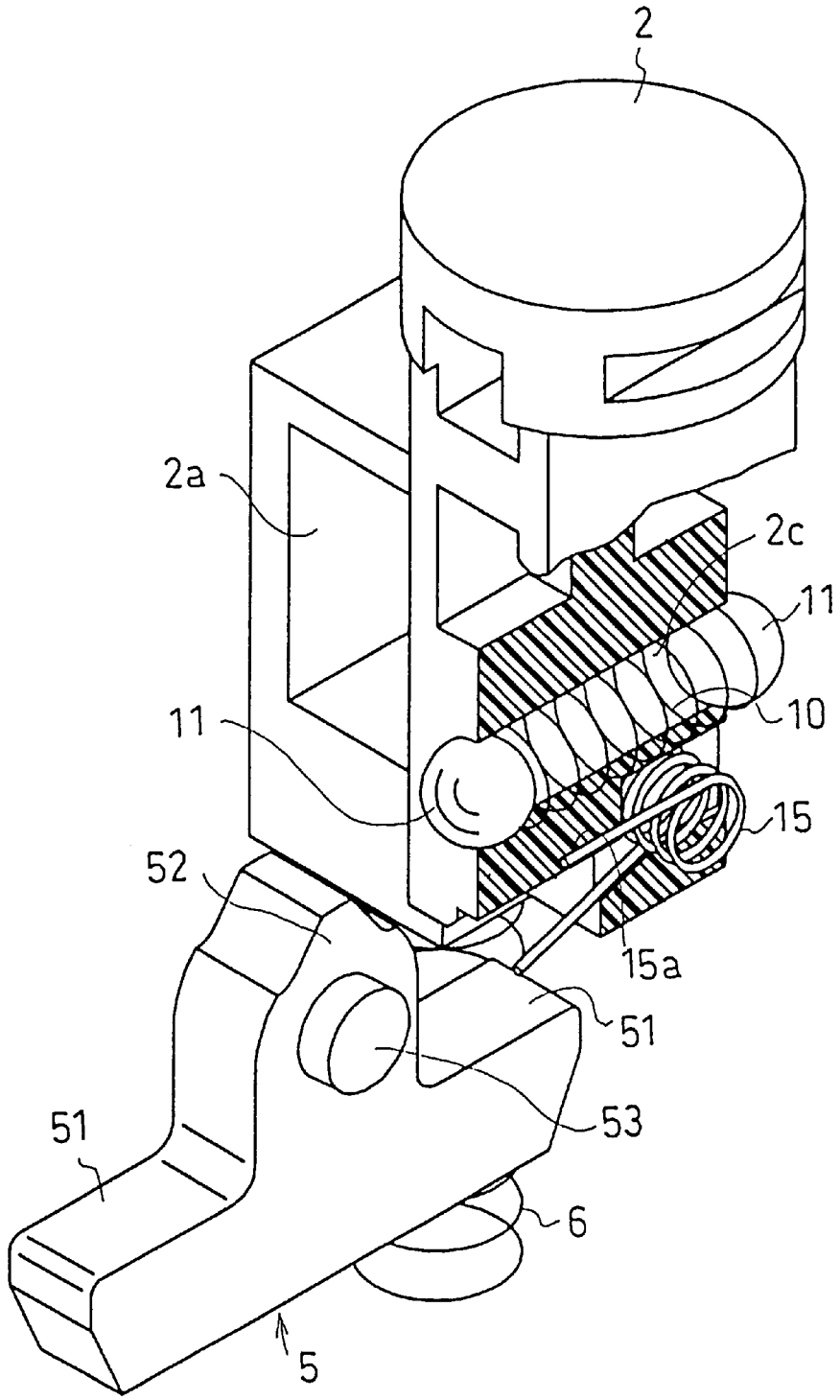

FIG. 14 is a perspective view of the main part of the above.

Figure 15:
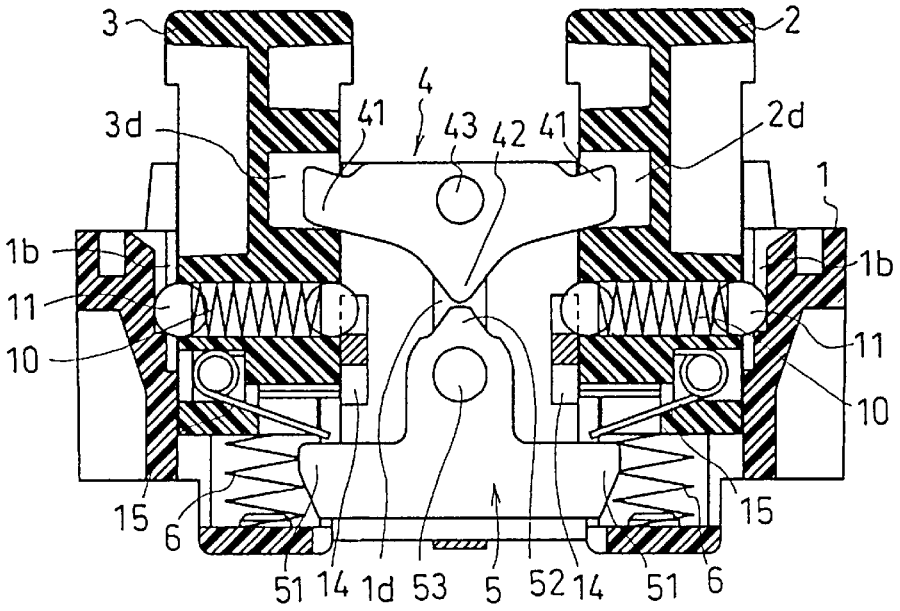

FIG. 15 is a sectional view of the above corresponding to the sectional view at line 3—3 of FIG. 1(*a*).

Figure 16:
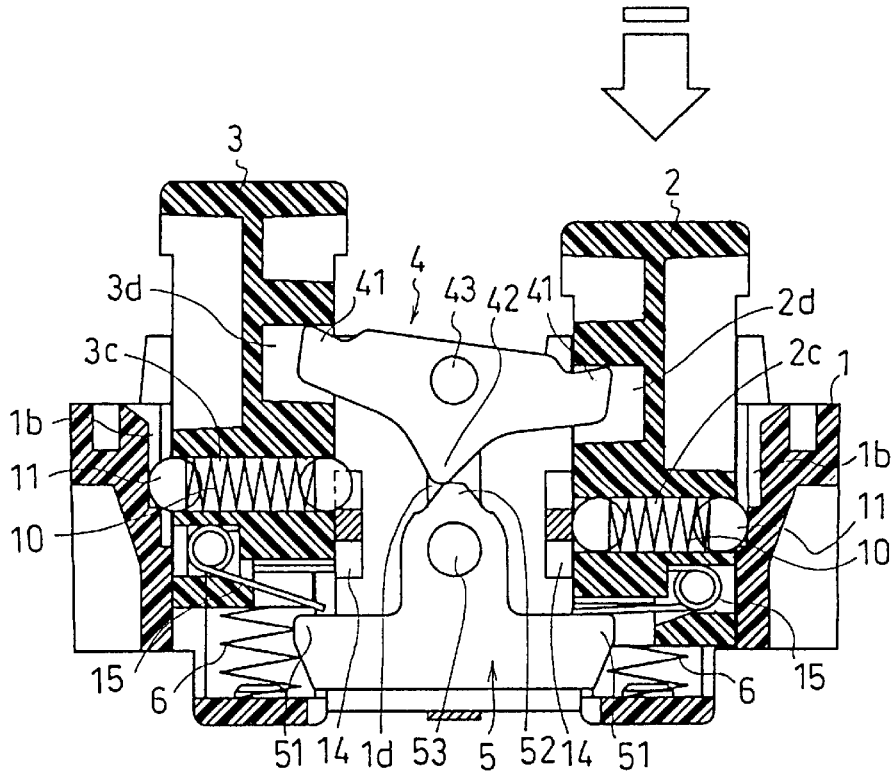

FIG. 16 is an explanatory drawing of the working state of the push-button switch in FIG. 13, corresponding to the sectional view at line 3—3 of FIG. 1(*a*), showing the state in which one of the push buttons is pressed down by two stages.

Figure 17:
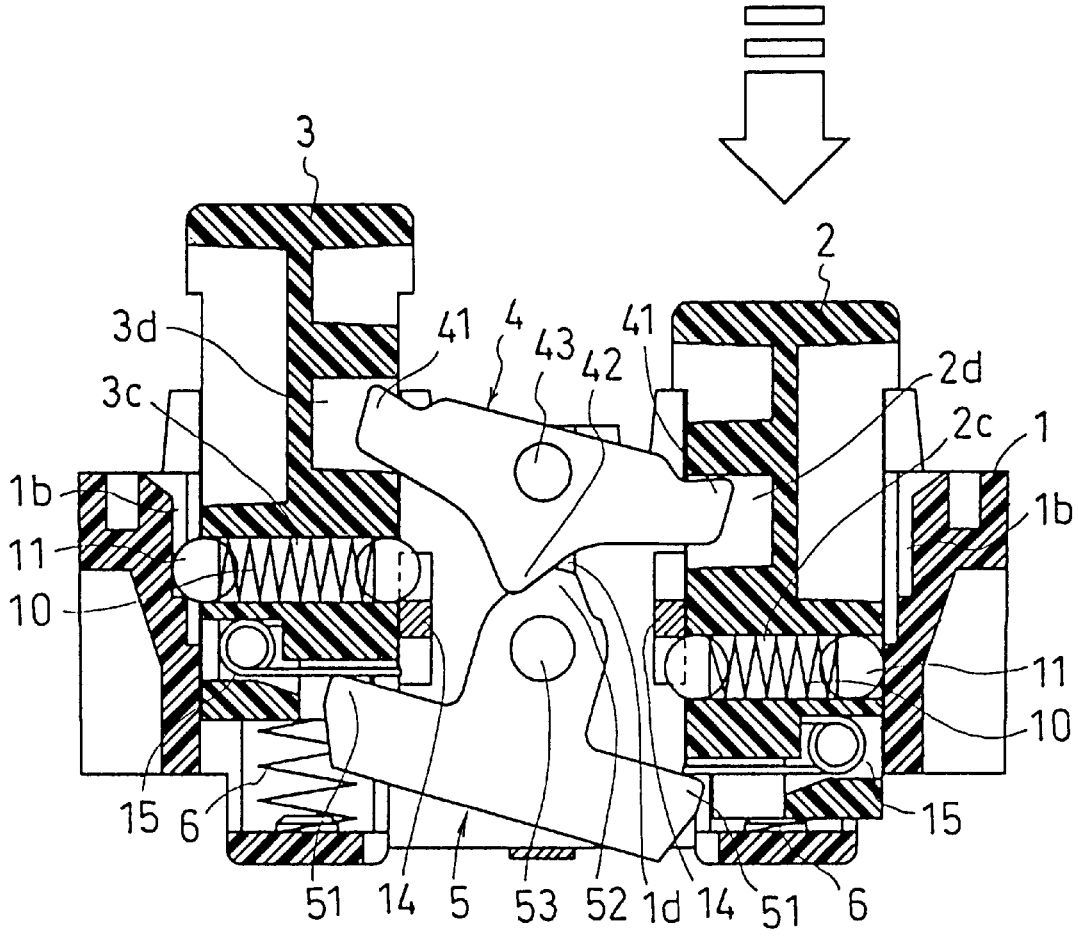

FIG. 17 is an explanatory drawing of the working state of the push-button switch in FIG. 13, corresponding to the sectional view at line 3—3 of FIG. 1(*a*), showing the state in which the two push buttons are pressed down simultaneously. The state where the second interlocking member is not inclined.

Figure 18:
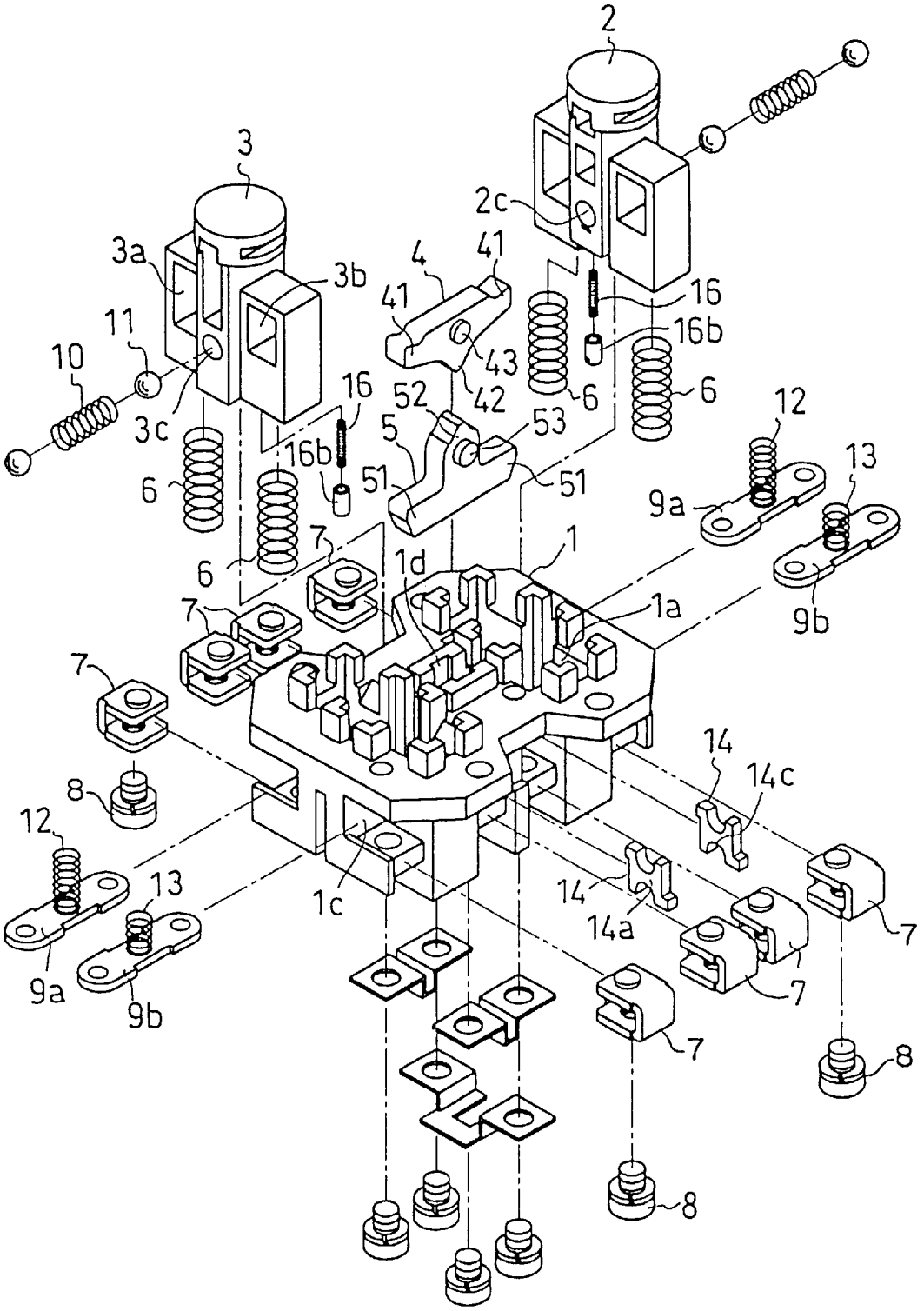

FIG. 18 is an exploded perspective view of a push-button switch which includes the interlocking device for a push-button switch according to the present invention and is a second variant of first embodiment.

Figure 19:
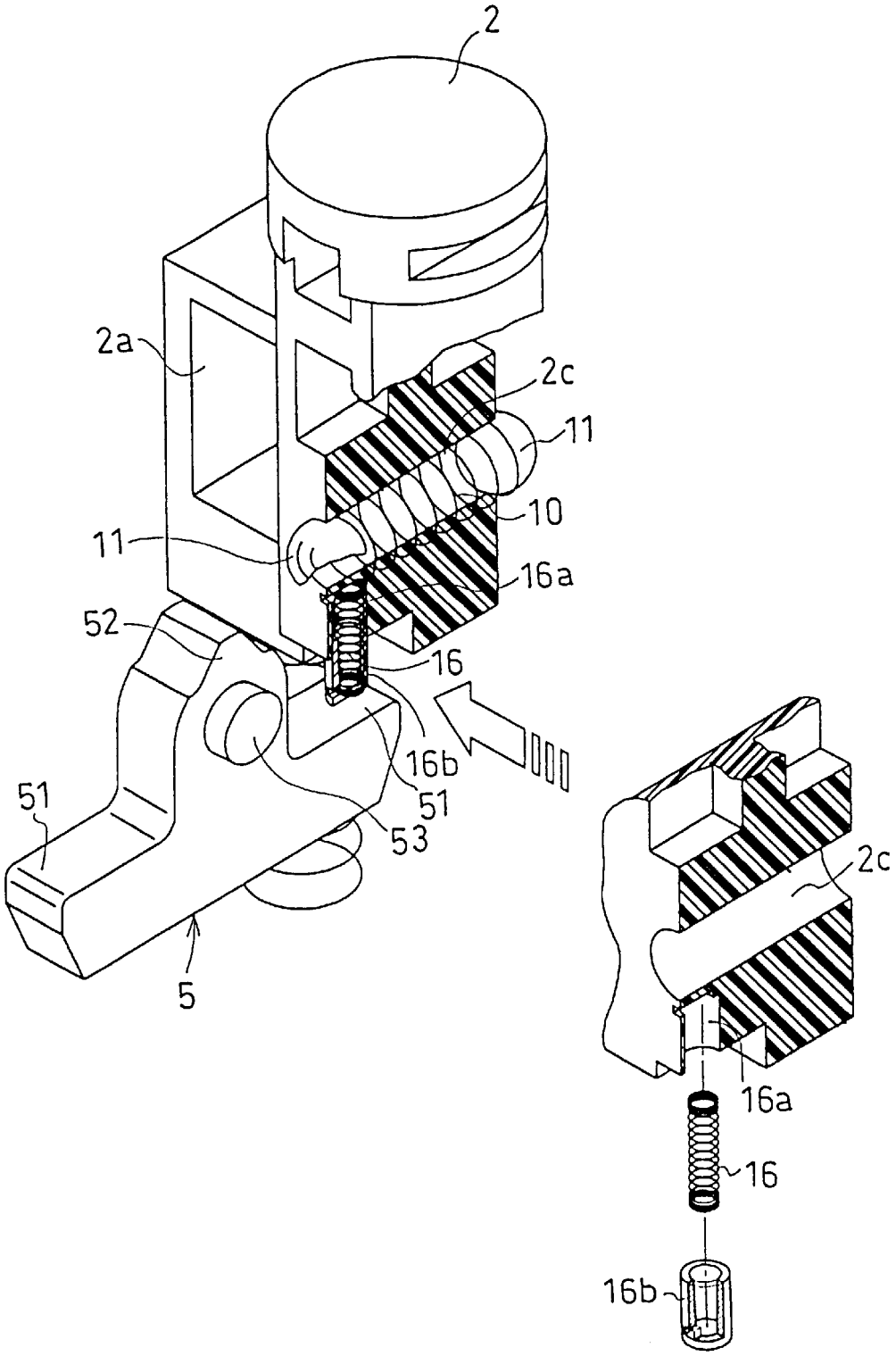

FIG. 19 is a perspective view of the main part of the above.

Figure 20:
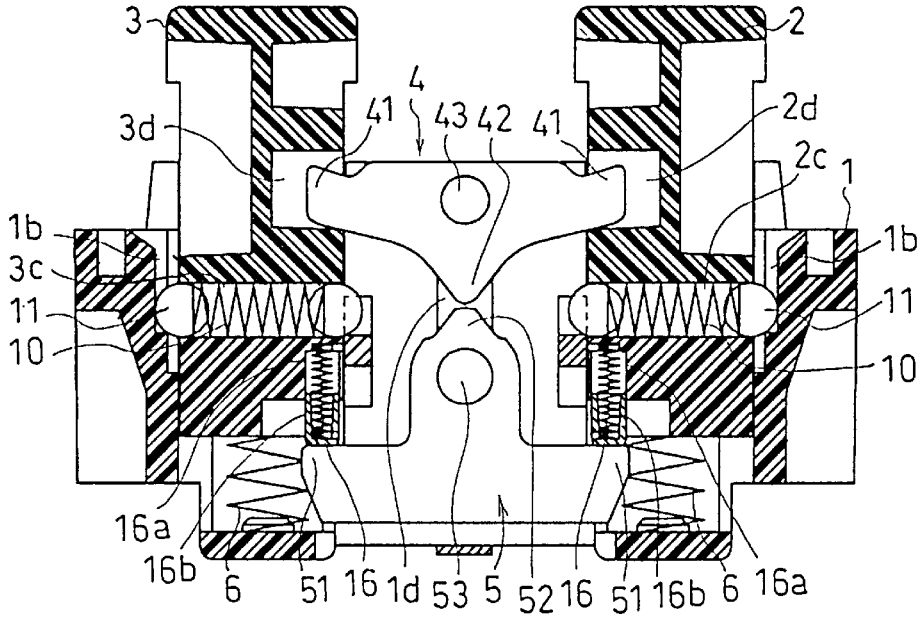

FIG. 20 is a sectional view of the above corresponding to the sectional view at line 3—3 of FIG. 1(*a*).

Figure 21:
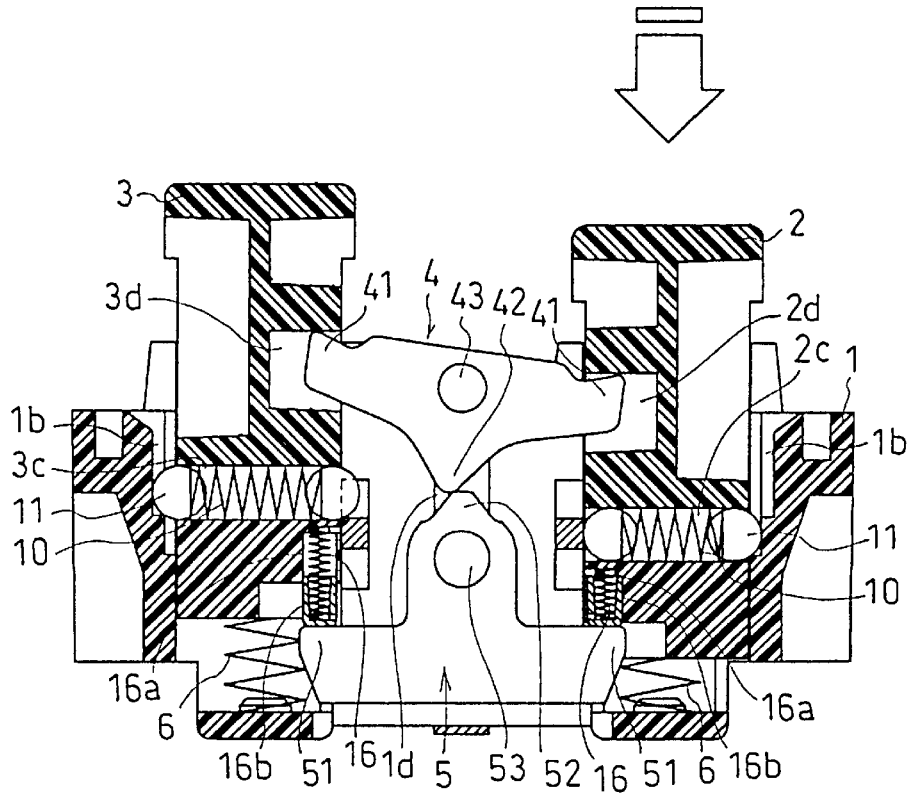

FIG. 21 is an explanatory drawing of the working state of the push-button switch in FIG. 18, corresponding to the sectional view at line 3—3 of FIG. 1(*a*), showing the state in which one of the push buttons is pressed down by two stages.

Figure 22:
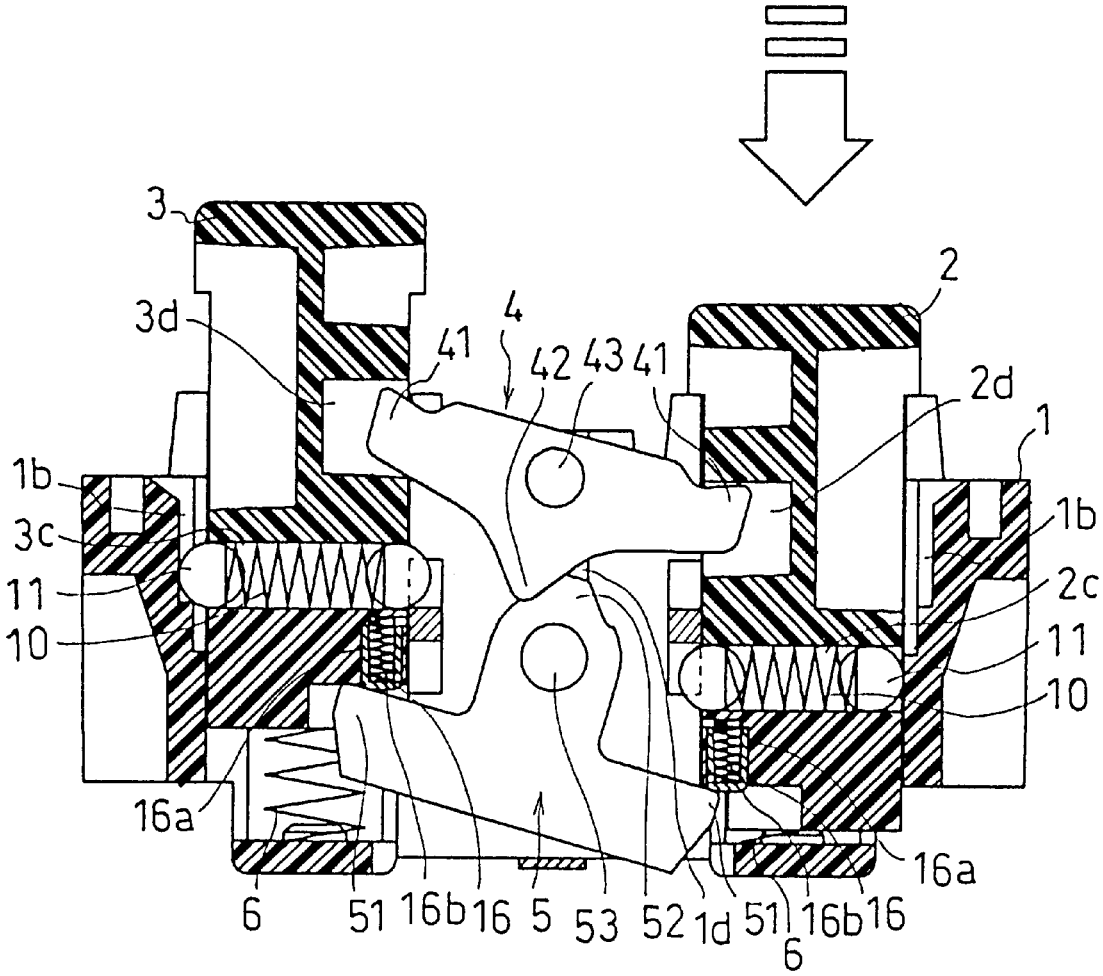

FIG. 22 is an explanatory drawing of the working state of the push-button switch in FIG. 18, corresponding to the sectional view at line 3—3 of FIG. 1(*a*), showing the state in which the two push buttons a repressed down simultaneously. The state where the second interlocking member is not inclined.

Figure 23:
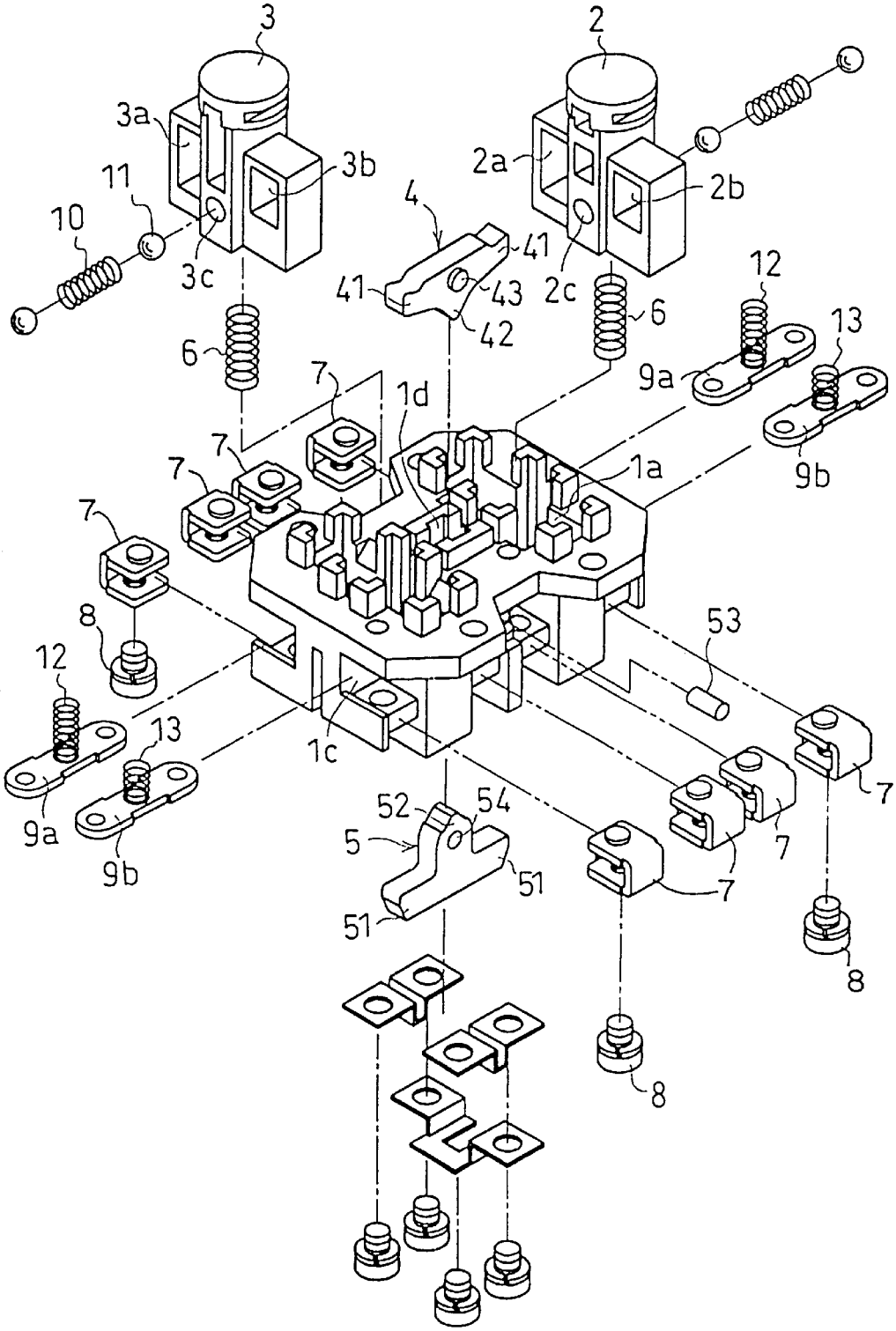

FIG. 23 is an exploded perspective view of a push-button switch which includes the interlocking device for a push-button switch according to the second embodiment of the present invention.

Figure 24:
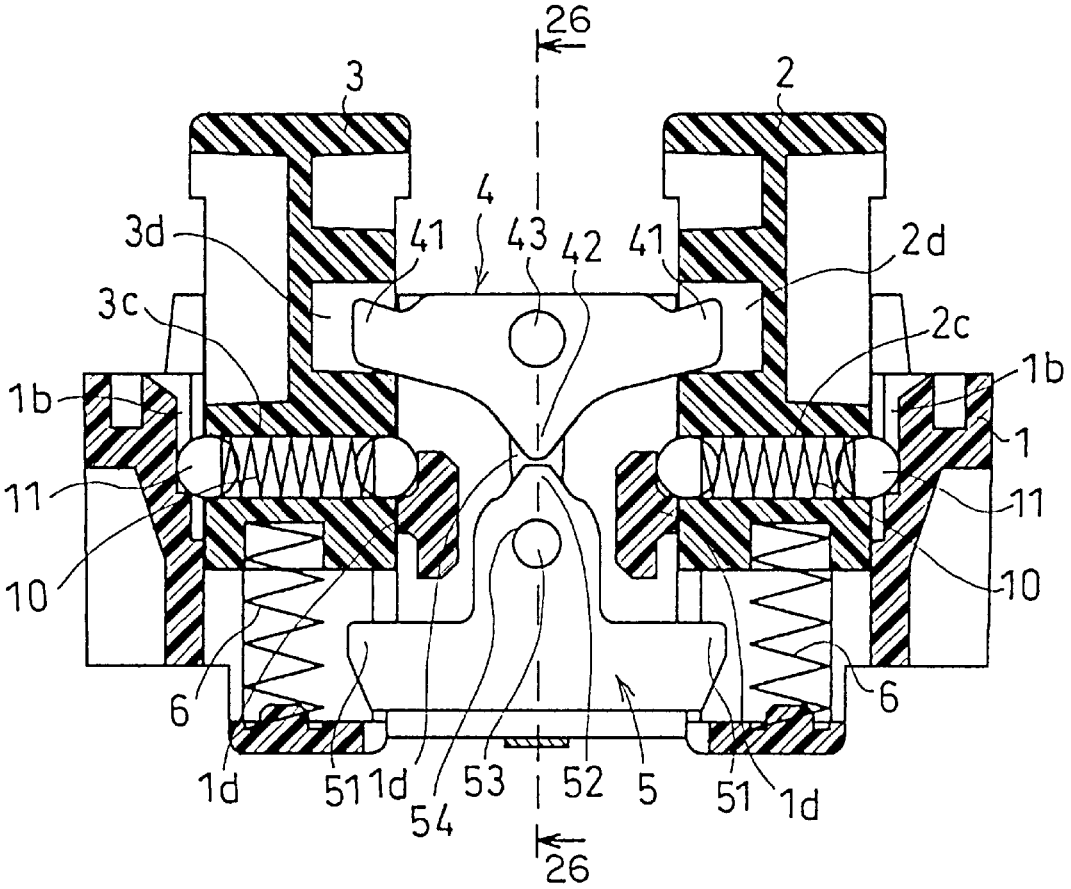

FIG. 24 is a sectional view of the above corresponding to the sectional view at line 3—3 of FIG. 1(*a*).

Figure 25:
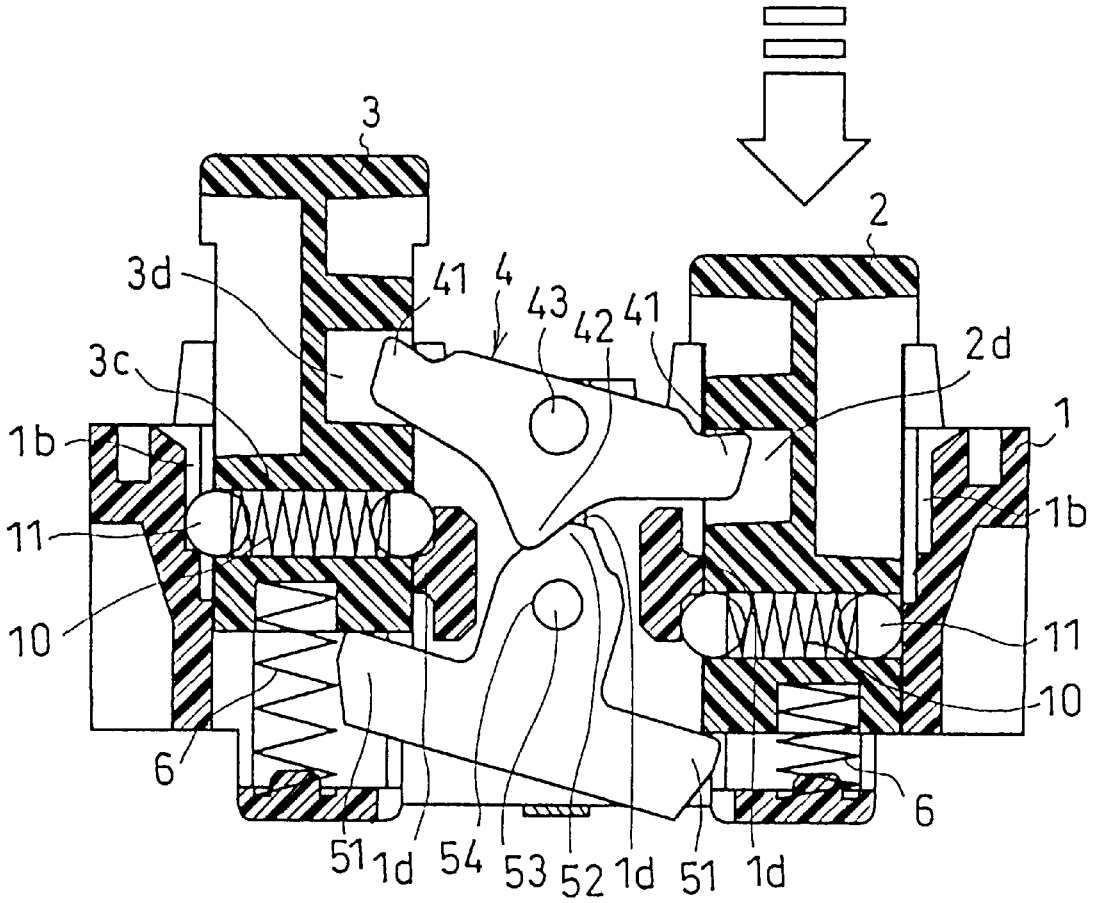

FIG. 25 is an explanatory drawing of the working state of the push-button switch in FIG. 23, corresponding to the sectional view at line 3—3 of FIG. 1(*a*), showing the state in which one of the push buttons is pressed down by two stages.

Figure 26:
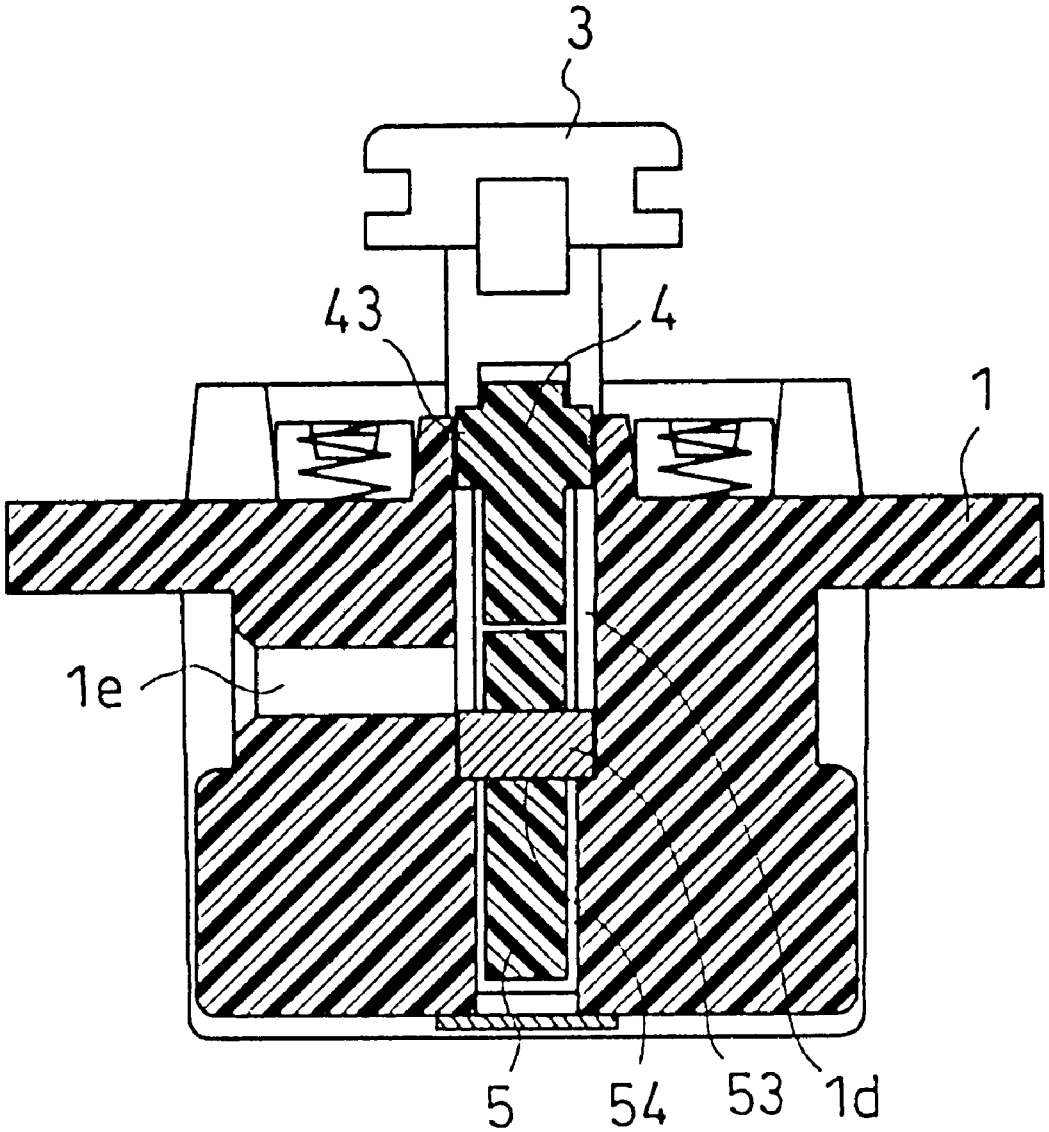

FIG. 26 is a sectional view at line 26—26 of FIG. 24.

FIG. 27 shows a clip mechanism of a push button, FIG. 27(*a*) showing a conventional example, FIG. 27(*b*) the first embodiment, and FIG. 27(*c*) the second embodiment.

DETAILED DESCRIPTION OF THE INVENTION

Embodiments of the interlocking device for a push-button switch according to the present invention will be explained hereafter based on the drawings.

FIG. 1 to FIG. 12 show the first embodiment in which the interlocking device for a push-button switch according to the present invention is applied to a two-stage push-button switch used for the operation of cranes and hoists.

This two-stage push-button switch is mainly comprised of two push buttons 2, 3 inserted in a housing groove 1*a* formed on the switch body 1, a first interlocking member 4 and a second interlocking member 5 constituting the interlocking device provided at a lower position of the push buttons 2, 3, a push button returning spring 6 provided between the switch body 1 and the push buttons 2, 3, four pairs of mobile contacts 7 and screws 8 for wiring terminal provided at the bottom of the switch body 1, mobile contacts 9*a*, 9*a* for the first stage and mobile contacts 9*b*, 9*b* for the second stage inserted in the mobile contact housing ports 2*a*, 2*b*, 3*a*, 3*b* of the push buttons 2, 3.

In the push buttons 2, 3, are drilled steel ball housing ports 2*c*, and steel balls 11, 11 urged by spring 10, constituting a clip mechanism, are inserted therein.

Moreover, on one side of the wall face of the housing groove 1*a*, formed on the switch body 1 in which the push buttons 2, 3 are inserted, is formed a stepped part 1*b* for the clip, while on the other side is disposed a steel ball receiving base 14 forming a partition 14*a* in the middle part, so that the push buttons 2, 3 may be clipped in two stages at prescribed pressed positions at the time of pressing of the push buttons 2, 3.

Furthermore, the mobile contacts 9*a*, 9*a* for the first stage, and the mobile contacts 9*b*, 9*b* for the second stage, in the mobile contact housing ports 2*a*, 2*b*, 3*a*, 3*b* of the push buttons 2, 3 are urged downward by a mobile contact spring 12 for the first stage and a mobile contact spring 13 for the second stage.

And, the push buttons 2, 3 are inserted in the housing groove 1*a* of the switch body 1, in the state protected against falling off as the mobile contacts 9*a*, 9*b* for the second stage come in contact, respectively, with the top face of the mobile contact housing port 1*c* drilled in the switch body 1.

The four pairs of fixed contacts 7 provided at the lower part of the switch body 1 in a way to face the mobile contacts 9*a*, 9*b* are constituted by forming an upward facing contact part at the upper piece of the U-shaped fixed contact pieces. The bottom piece of the respective fixed contact pieces are connected by the screw 9 for a wiring terminal.

FIG. 1(*e*) indicates the relationship between the mobile contacts 9*a*, 9*a* for the first stage, and the mobile contacts 9*b*, 9*b* for the second stage, of the two push buttons 2, 3 and the four pairs of contacts (①-②, ③-④, ⑤-⑥, ⑦-⑧.

Figure 2:
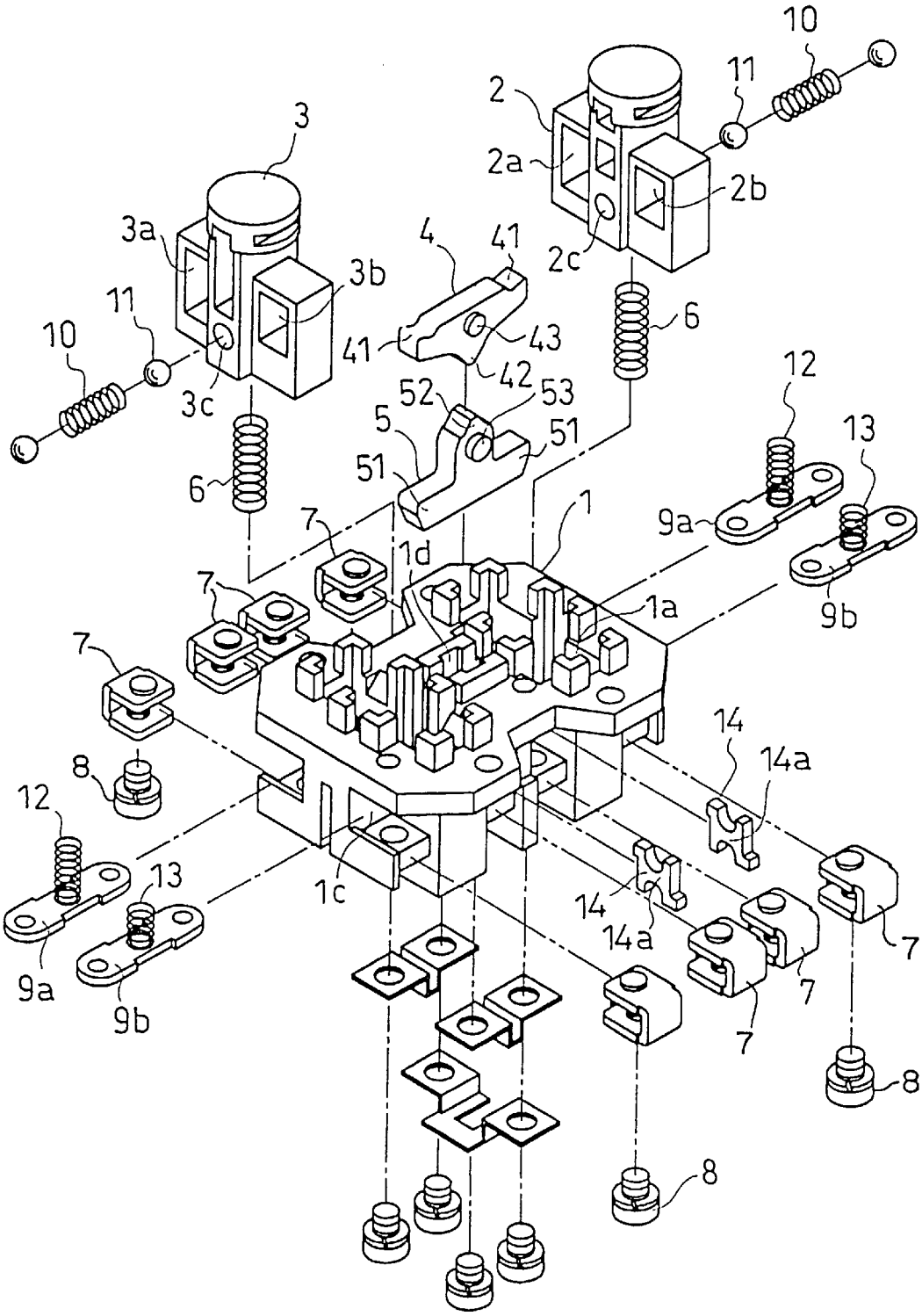
FIG. 2 is an exploded perspective view of the push-button switch in FIG. 1.
Figure 3:
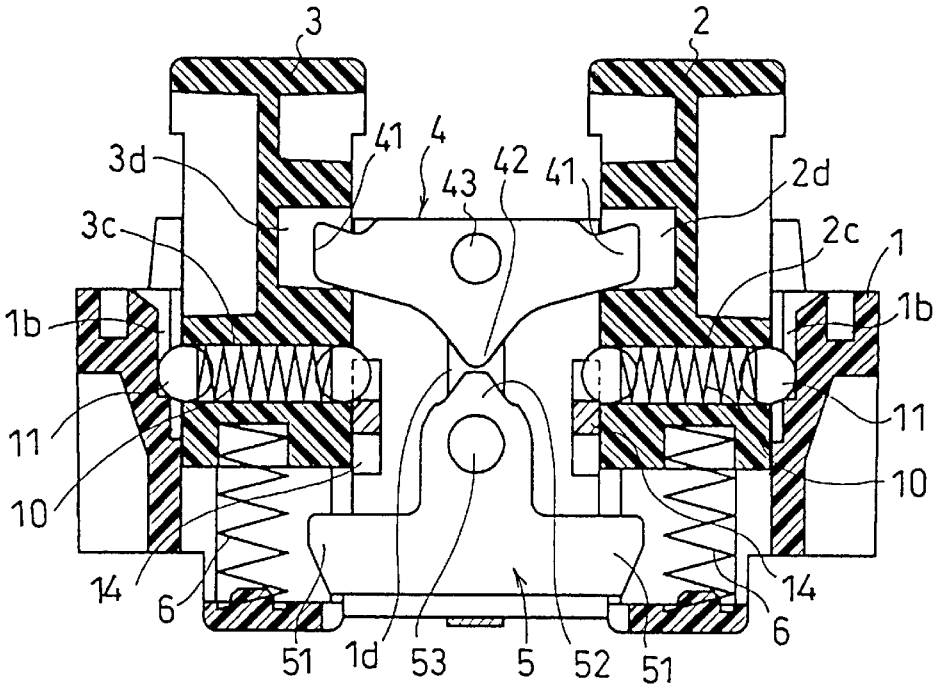
FIG. 3 is a sectional view at line 3—3 of FIG. 1(*a*).
Figure 4:
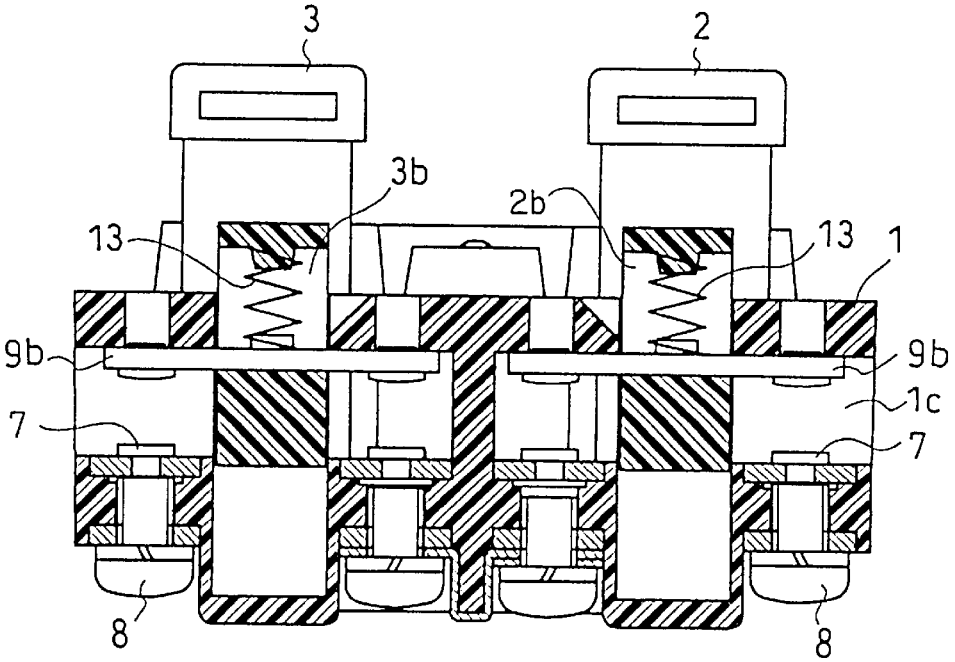
FIG. 4 is a sectional view at line 4—4 of FIG. 1(*a*).
Figure 5:
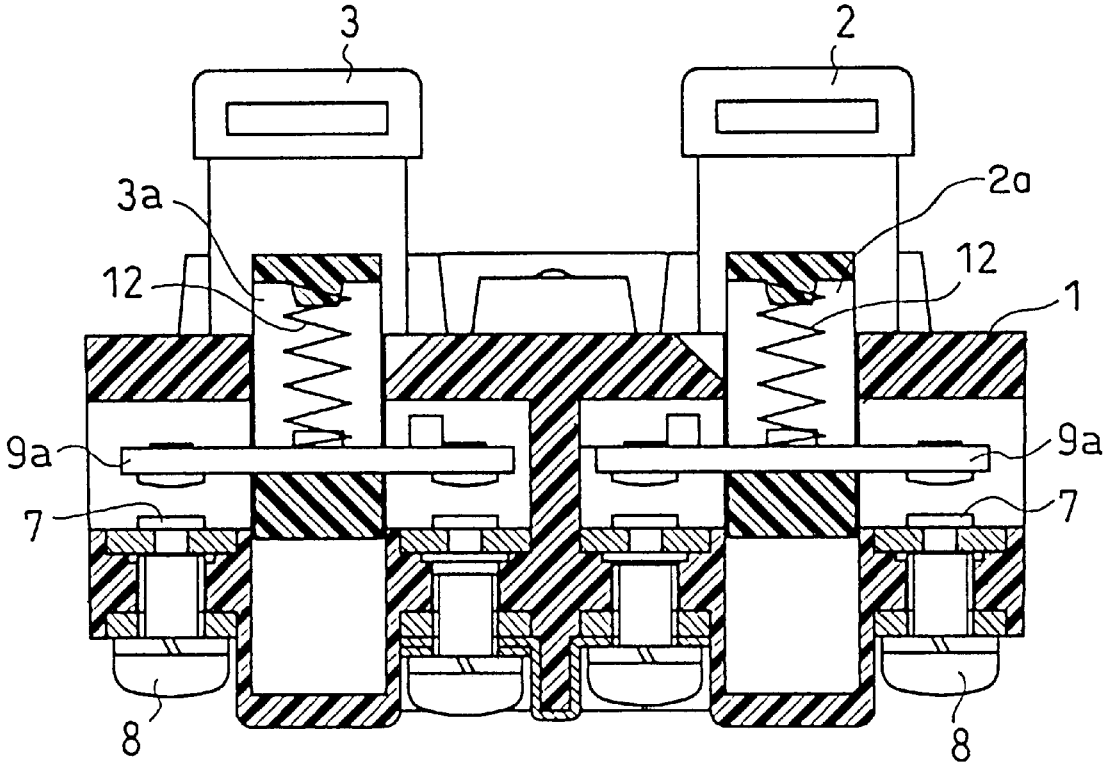
FIG. 5 is a sectional view at line 5—5 of FIG. 1(*a*).
Figure 6:
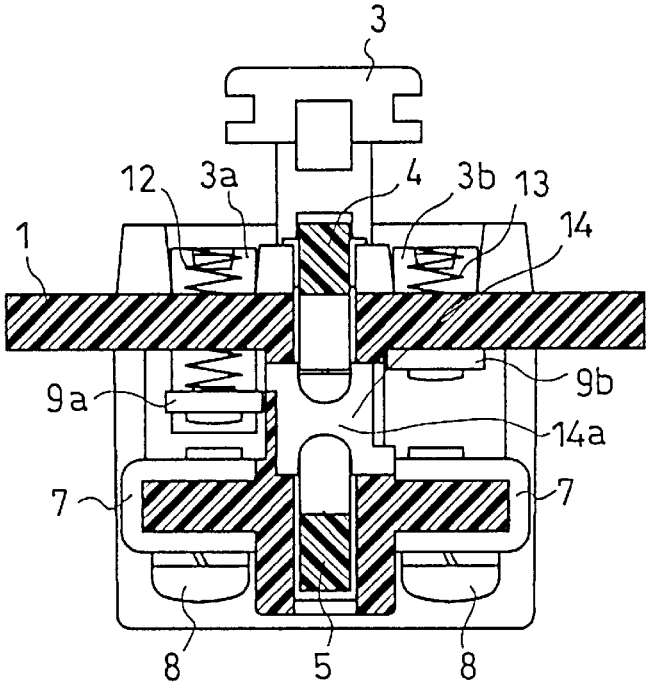
FIG. 6 is a sectional view at line 6—6 of FIG. 1(*b*).
Figure 7:
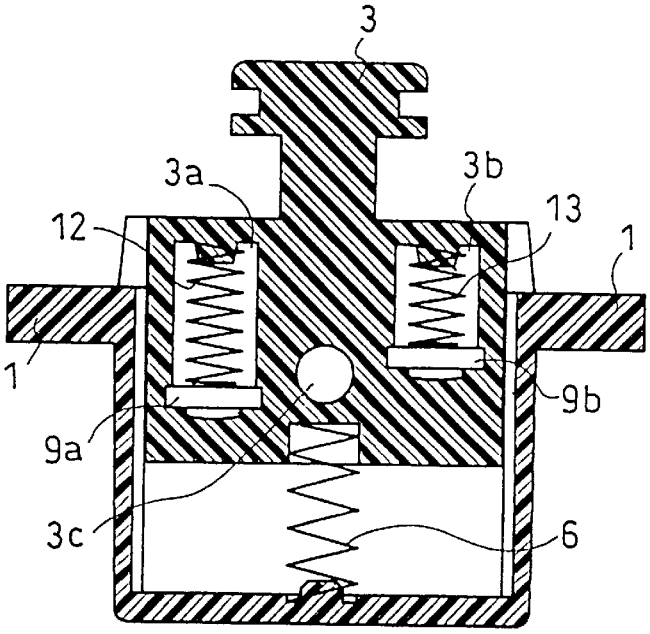
FIG. 7 is a sectional view at line 7—7 of FIG. 1(*b*).

The interlocking device is constituted with the first interlocking member 4 and the second interlocking member 5, of which the first interlocking member 4 is inserted, as shown in FIG. 3, in the concave parts 2*d*, 3*d* with both ends 41, 41 disposed in the push buttons 2, 3 respectively. The first interlocking member 4 also includes a projection 42 at the lower part, so as to be disposed swingably and in a way to be movable up and down through a spindle 43 inserted in the concave groove id formed in the switch body 1.

Furthermore, the second interlocking member 5 has its both ends 51, 51 extended, as shown in FIG. 3, at a lower position of the push buttons 2, 3, and forms, at its top part, a projection 52 which comes in contact with the projection 42 formed on the first interlocking member 4, and is provided swingably through a spindle 53 inserted in the concave groove 1*d* formed in the switch body 1.

Also, while, in this embodiment, the spindle 43 of the first interlocking member 4 and the spindle 53 of the second interlocking member 5 are formed integrally with either the first interlocking member 4 or the second interlocking member 5, it is also possible to construct them as separate members and/or insert the spindle 43 and the spindle 53 in either the first interlocking member or the second interlocking member 5.

Figure 8:
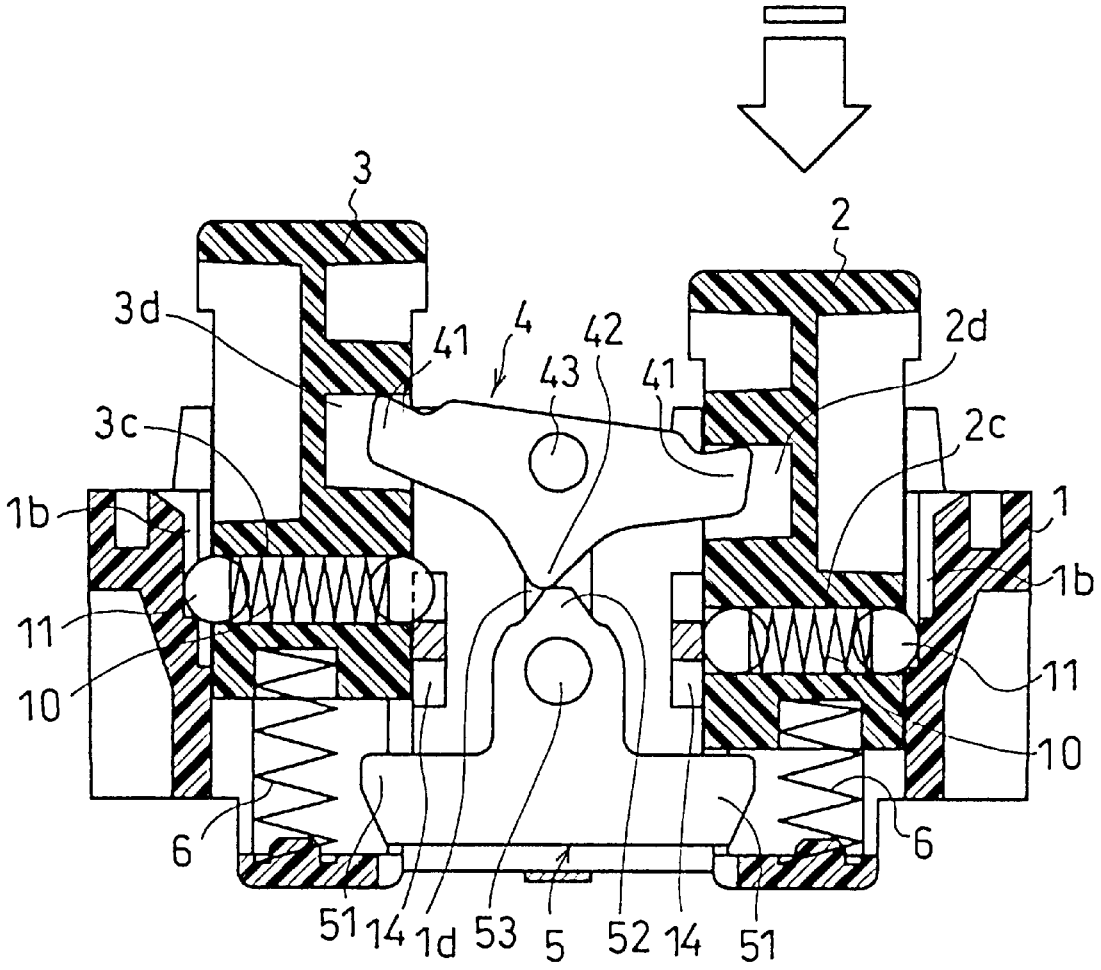
FIG. 8 is an explanatory drawing of the working state of the push-button switch in FIG. 1 (sectional view at line 3—3 of FIG. 1(*a*)), showing the state in which one of the push buttons is pressed down by one stage.

In this case, when one of the push buttons 2, 3, for example push button 2, is pressed down by one stage, as shown in FIG. 8, the tip of the projection 42 of the first interlocking member 4 and the projection 52 of the second interlocking member 5 will be formed of a slightly curved surface, for example, a cylindrical surface in this embodiment, so that only the first interlocking member 4 may smoothly swing through the spindle 43 while the tip of the projection 42 of the first interlocking member 4 and the projection 52 of the second interlocking member 5 come in contact with each other.

Figure 9:
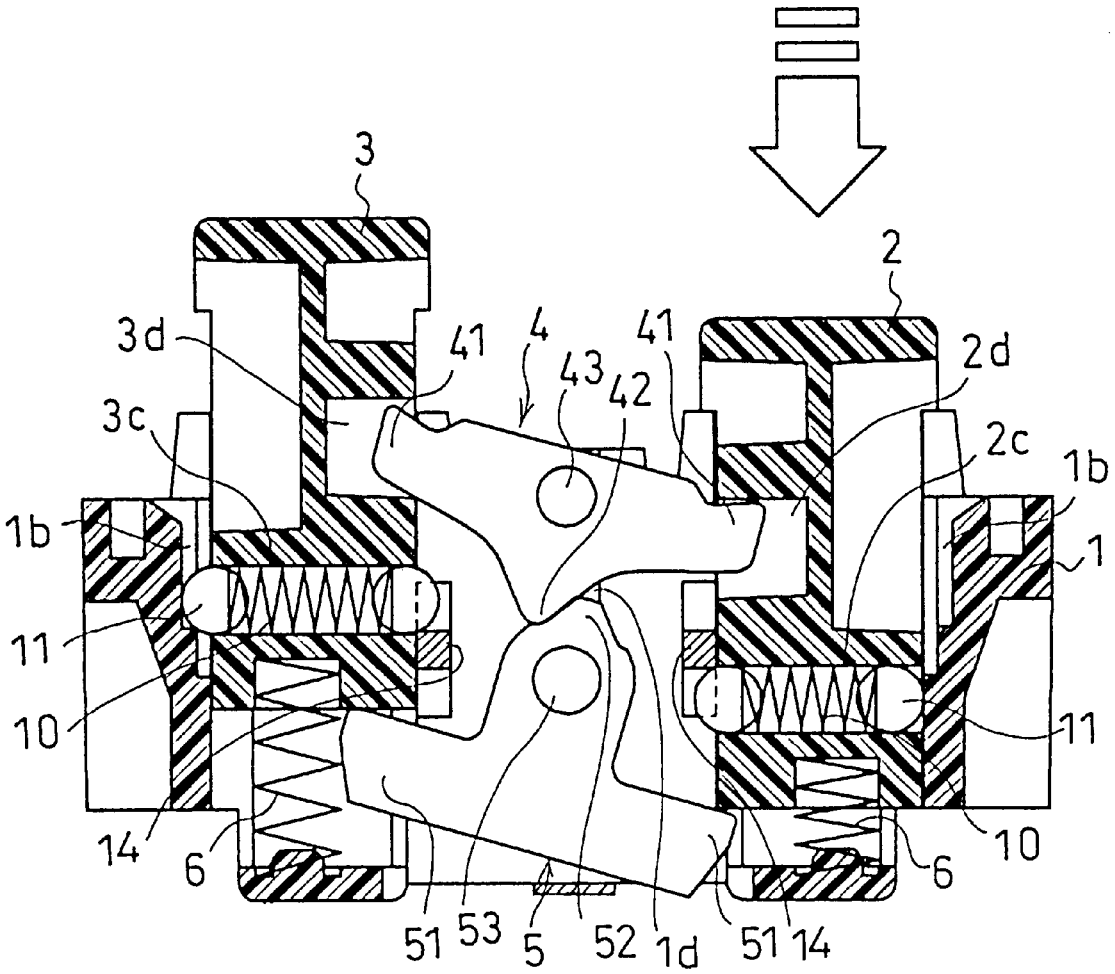
FIG. 9 is an explanatory drawing of the working state of the push-button switch in FIG. 1 (sectional view at line 3—3 of FIG. 1(*a*)), showing the state in which one of the push buttons is pressed down by two stages.

And, it will be so arranged that, when one of the push buttons 2, 3, for example, push button 2, is pressed down by two stages, as shown in FIG. 9, the second interlocking member 5 swings through the spindle 53, as the edge parts 51 of the second interlocking member 5 are provided in a way to be extended to a lower position of the push buttons 2, 3 respectively. In addition, while the first interlocking member 4 further swings through the spindle 43, as the push button 2 is pressed down by two stages, the side face continuing to the tip part of the projection 42 of the first interlocking member 4 and the projection 52 of the second interlocking member 5 will be formed of a slightly curved surface in a contact face, so that, at that time, the tip of the projection 42 of the first interlocking member 4 may be detached from the tip part of the projection 52 of the second interlocking member 5 and the position of the spindle 43 of the first interlocking member 4 may smoothly move downward.

Next, explanation will be given regarding the motions of the interlocking device of this push-button switch.

When one of the push buttons 2, 3, push button 2 in the illustration, is pressed down from the state in which the push buttons 2, 3 are not pressed down (FIG. 3), only the first interlocking member 4 swings around the spindle 43 while the tip of the projection 42 of the first interlocking member 4 and the tip of the projection 52 of the second interlocking member 5 remain in contact with each other, as shown in FIG. 8, and the push button 2 can be pressed down without trouble, to close the fixed contact 7 with its mobile contact 9*a* for the first stage.

At that time, the other push button 3 is prevented from being pressed down, because the end part 41 of the first interlocking member 4 is inserted in the concave part 3*d* formed in the push button 3.

When, from this state, the push button 2 is further pressed down, i.e., pressed down by 2 stages, the end part 51 of the second interlocking member 5 provided in a way to be extended to the lower part of the push buttons 2, 3 respectively is pushed down to the bottom face of the push button 2, as shown in FIG. 9, and the second interlocking member 5 swings around the spindle 53.

As a result, the first interlocking member 4 further swings around the spindle 43, and the tip of the projection 42 of the first interlocking member 4 is detached from the tip part of the projection 52 of the second interlocking member 5 and the position of the spindle 43 of the first interlocking member 4 smoothly moves downward, thus making it possible for the push button 2 to be pressed down easily and to close the fixed contact 7 with its mobile contact 9*b* for the second stage.

At that time, the other push button 3 is prevented from being pressed down, because the end part 41 of the first interlocking member 4 is inserted in the concave part 3*d* formed in the push button 3 and the end part 51 of the second interlocking member 5 is extended to the lower part of the push button 3.

Moreover, when the pressing down force on the push button 2 is released, the push button 2 automatically returns to its initial state indicate in FIG. 3 with the urging force of the spring 6 for returning the push button.

Figure 10:
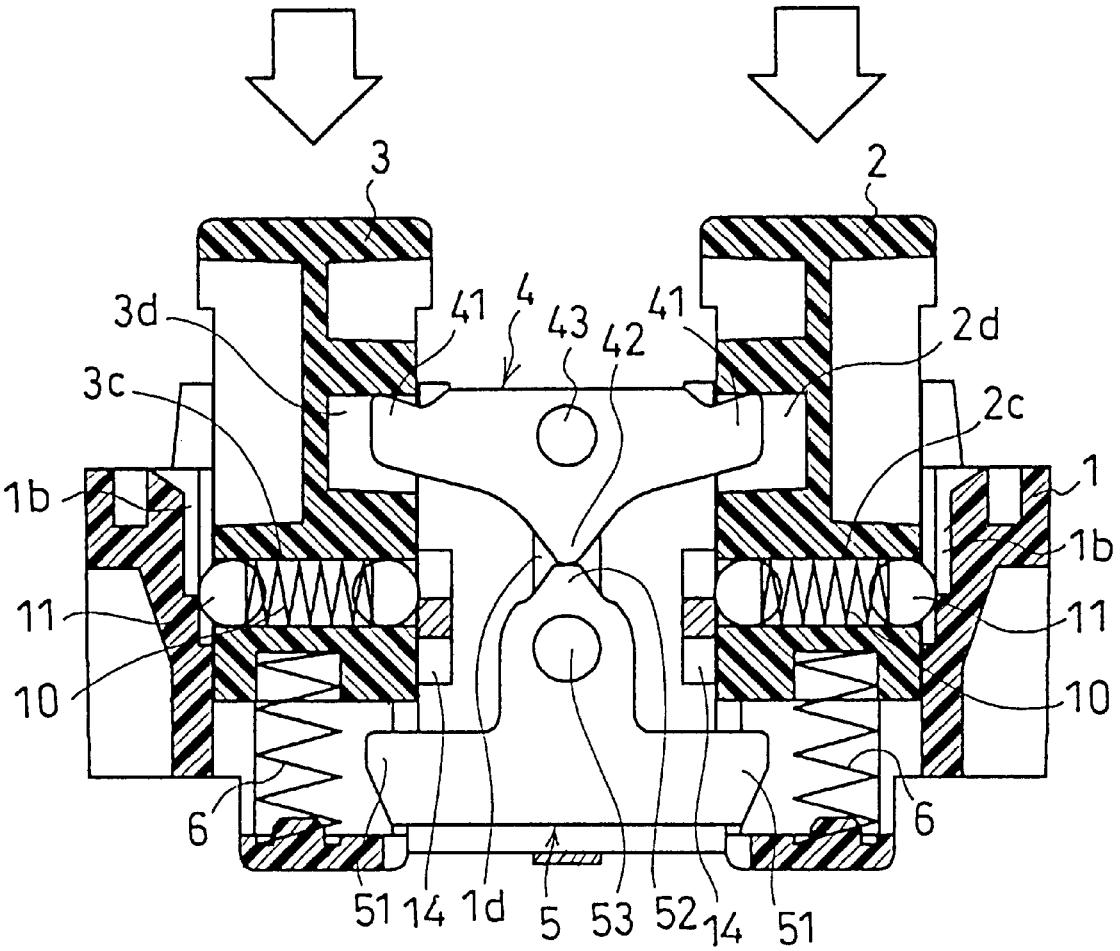
FIG. 10 is an explanatory drawing of the working state of the push-button switch in FIG. 1 (sectional view at line 3—3 of FIG. 1(*a*)), showing the state in which the two push buttons are pressed down simultaneously. The state where the second interlocking member is not inclined.
Figure 11:
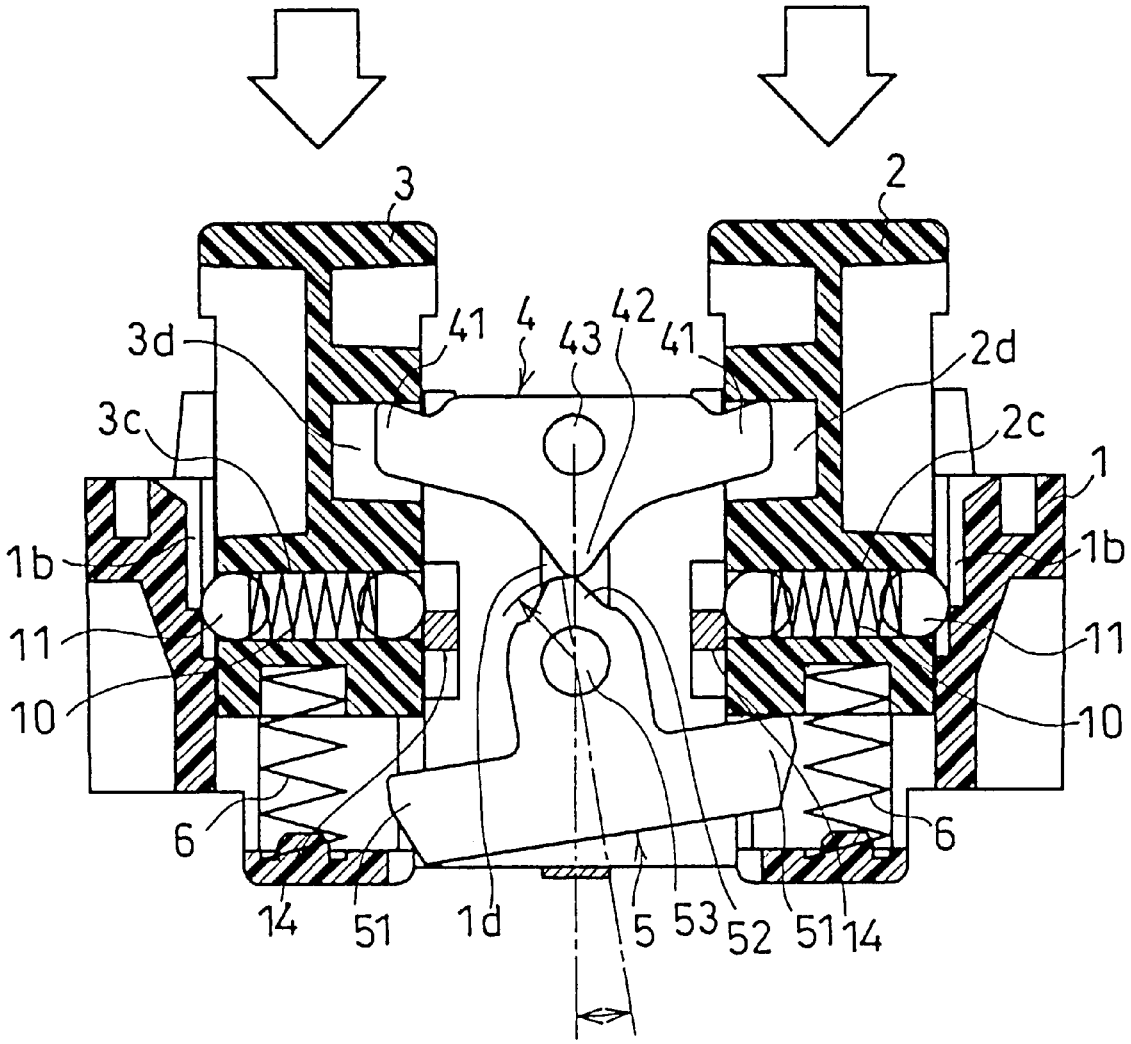
FIG. 11 is an explanatory drawing of the working state of the push-button switch in FIG. 1 (sectional view at line 3—3 of FIG. 1(*a*)), showing the state in which the two push buttons are pressed down simultaneously. The state where the second interlocking member is inclined to the extreme left.

On the other hand, in the case where an attempt is made to press down the both push buttons 2, 3 simultaneously, from a state where the push buttons 2, 3 are not pressed down (FIG. 3), phenomena as indicated in FIG. 10, the state where the second interlocking member 5 is not inclined, FIG. 11, the state where the second interlocking member 5 is inclined to the extreme left, and FIG. 12, the state where the second interlocking member 5 is inclined to the extreme right, may occur. However, in either case, the first interlocking member 4 is held in the same position, thereby preventing pressing down of the push buttons 2, 3 in the concave parts 2*d*, 3*d* of which the both ends 41, 41 of the first interlocking member 4 are inserted respectively.

FIG. 13 to FIG. 17 show the first variant of the interlocking device in the push-button switch of the first embodiment.

In this embodiment, a torsion spring 15 for controlling the posture of the second interlocking member 5 is interposed between the push buttons 2, 3 and the second interlocking member 5.

Specifically, one end of the torsion spring 15 is inserted in a spring insertion hole 15*a* formed in the push buttons 2, 3 to support the torsion spring 15, while the other end is in contact with the end part 51 of the second interlocking member 5 extended to the lower part of the push buttons 2, 3 respectively, as shown in FIG. 14 and FIG. 15.

As a result, when one of the push buttons 2, 3, push button 2 in the illustration, is pressed down from the state in which the push buttons 2, 3 are not pressed down (FIG. 15), only the first interlocking member 4 swings around the spindle 43 while the tip of the projection 42 of the first interlocking member 4 and the tip of the projection 52 of the second interlocking member 5 remain in contact with each other, as shown in FIG. 16, and the push button 2 can be pressed down without trouble, to close the fixed contact 7 with its mobile contact 9*a* for the first stage.

When, from this state, the push button 2 is further pressed down, pressing down by two stages, before the end part 51 of the second interlocking member 5 provided in a way to be extended to the lower part of the push buttons 2, 3 respectively is pushed down to the bottom face of the push button 2, as shown in FIG. 17, the second interlocking member 5 can be made to swing around the spindle 53 through the torsion spring 15, thus ensuring a smooth swinging motion of the second interlocking member 5.

As a result, the first interlocking member 4 further swings around the spindle 43, and the tip of the projection 42 of the first interlocking member 4 is detached from the tip part of the projection 52 of the second interlocking member 5 and the position of the spindle 43 of the first interlocking member 4 smoothly moves downward, thus making it possible for the push button 2 to be pressed down easily and close the fixed contact 7 with its mobile contact 9*b* for the second stage.

Other basic constructions and basic motions of this embodiment are the same as those of the interlocking device of the push-button switch in the first embodiment.

FIG. 18 to FIG. 22 show the second variant of the interlocking device in the push-button switch of the first embodiment.

In this embodiment, a compression spring 16 for controlling the posture of the second interlocking member 5 is interposed between the push buttons 2, 3 and the second interlocking member 5.

Specifically, the top end of the compression spring 16 is inserted in a spring insertion hole 16*a* formed in the push buttons 2, 3 to support the compression spring 16, while the lower end is in contact with the end part 51 of the second interlocking member 5 extended to the lower part of the push buttons 2, 3 respectively, as shown in FIG. 19 and FIG. 20.

In this case, an auxiliary cylinder 16*b* having a bottom may be loaded at the bottom end of the compression spring 16, so that the compression spring 16 may accurately contact the end part 51 of the second interlocking member 5.

As a result, when one of the push buttons 2, 3, push button 2 in the illustration, is pressed down from the state in which the push buttons 2, 3 are not pressed down (FIG. 20), only the first interlocking member 4 swings around the spindle 43 while the tip of the projection 42 of the first interlocking member 4 and the tip of the projection 52 of the second interlocking member 5 remain in contact with each other, as shown in FIG. 21, and the push button 2 can be pressed down without trouble, to close the fixed contact 7 with its mobile contact 9*a* for the first stage.

When, from this state, the push button 2 is further pressed down, pressed down by two stages, before the end part 51 of the second interlocking member 5 provided in a way to be extended to the lower part of the push buttons 2, 3 respectively is pushed down to the bottom face of the push button 2, as shown in FIG. 22, the second interlocking member 5 can be made to swing around the spindle 53 through the compression spring 16, thus ensuring a smooth swinging motion of the second interlocking member 5.

As a result, the first interlocking member 4 further swings around the spindle 43, and the tip of the projection 42 of the first interlocking member 4 is detached from the tip part of the projection 52 of the second interlocking member 5 and the position of the spindle 43 of the first interlocking member 4 smoothly moves downward, thus making it possible for the push button 2 to be pressed down easily and close the fixed contact 7 with its mobile contact 9*b* for the second stage.

Other basic constructions and basic motions of this embodiment are the same as those of the interlocking device of the push-button switch in the first embodiment.

FIG. 23 to FIG. 26 show the second embodiment in which the interlocking device for a push-button switch according to the present invention is applied to a two-stage push-button switch used for the operation of cranes and hoists.

This two-stage push-button switch, having the same basic structure as that of the push-button switch in the first embodiment, is mainly comprised of two push buttons 2, 3 inserted in a housing groove 1*a* formed on the switch body 1, a first interlocking member 4 and a second interlocking member 5 constituting the interlocking device provided at a lower position of the push buttons 2, 3, a push button returning spring 6 provided between the switch body 1 and the push buttons 2, 3, four pairs of mobile contacts 7 and screws 8 for a wiring terminal provided at the bottom of the switch body 1, mobile contacts 9*a*, 9*a* for the first stage and mobile contacts 9*b*, 9*b* for the second stage inserted in the mobile contact housing ports 2*a*, 2*b*, 3*a*, 3*b* of the push buttons 2, 3.

In this embodiment, the spindle 53 of the second interlocking member 5 is constructed separately from the second interlocking member 5 and, at the time of assembling of the push-button switch, the second interlocking member 5 is inserted from below the housing groove 1*a* formed on the switch body 1 (in the push-button switch of the first embodiment, the second interlocking member 5 is inserted from above the housing groove 1*a* formed on the switch body 1 to assemble the push-button switch). The spindle 53 is inserted through a through hole 1*e* formed on the switch body 1 and is inserted in a through hole 54 formed on the second interlocking member 5, to assemble the push-button switch.

Moreover, on one side of the wall face of the housing groove 1*a*, formed on the switch body 1 in which the push buttons 2, 3 are inserted, is formed a stepped part 1*b* for a clip, while on the other side is disposed a partition 1*d*, so that the push buttons 2, 3 may be clipped in two stages at prescribed pressed positions at the time of pressing of the push buttons 2, 3.

The motions of the interlocking device of this push-button switch are the same as those of the push-button switch in the first embodiment and, when one of the push buttons 2, 3, push button 2 in the illustration, is pressed down from the state in which the push buttons 2, 3 are not pressed down (FIG. 24), only the first interlocking member 4 swings around the spindle 43 while the tip of the projection 42 of the first interlocking member 4 and the tip of the projection 52 of the second interlocking member 5 remain in contact with each other, and the push button 2 can be pressed down without trouble, to close the fixed contact 7 with its mobile contact 9*a* for the first stage.

At that time, the other push button 3 is prevented from being pressed down, because the end part 41 of the first interlocking member 4 is inserted in the concave part 3*d* formed in the push button 3.

And, when the push button 2 is further pressed down, pressed down by two stages, the end part 51 of the second interlocking member 5 provided in a way to be extended to the lower part of the push buttons 2, 3 respectively, is pushed down to the bottom face of the push button 2, as shown in FIG. 25, and the second interlocking member 5 swings around the spindle 53.

As a result, the first interlocking member 4 further swings around the spindle 43, and the tip of the projection 42 of the first interlocking member 4 is detached from the tip part of the projection 52 of the second interlocking member 5 and the position of the spindle 43 of the first interlocking member 4 smoothly moves downward, thus making it possible for the push button 2 to be pressed down easily and close the fixed contact 7 with its mobile contact 9*b* for the second stage.

At that time, the other push button 3 is prevented from being pressed down, because the end part 41 of the first interlocking member 4 is inserted in the concave part 3*d* formed in the push button 3 and the end part 51 of the second interlocking member 5 is extended to the lower part of the push button 3.

Moreover, when the pressing down force on the push button 2 is released, the push button 2 automatically returns to its initial state indicated in FIG. 24 with the urging force of the spring 6 for returning the push button.

Furthermore, in the case where an attempt is made to press down both push buttons 2, 3 simultaneously, from a state where the push buttons 2, 3 are not pressed down (FIG. 24), pressing down of the push buttons 2, 3, in the concave parts 2*d*, 3*d* of which the both ends 41, 41 of the first interlocking member 4 are inserted respectively, is prevented.

Also, while, in the push-button switch of the first and second embodiments, the push buttons 2, 3 are constructed in a way to be clipped in two stages at prescribed pressed down position, a construction forming steps 1*b*, 1*b* in the shape of a ladder arranged on both sides for symmetrical clipping, as shown in FIG. 27(*a*), has been widely used as such a clipping mechanism in the past.

However, in the case of a conventional clipping mechanism forming steps 1*b*, 1*b* for symmetrical clipping arranged on both sides in the shape of a ladder, there was a problem that the urging force of the spring 10 for the steel ball increases as the push buttons are pressed down in multiple steps, thus deteriorating the operability of the push-button switch.

As a solution to this problem, in these embodiments, an improvement of operability is made by either forming a stepped part for clip 1*b* one side of the wall face of the housing groove 1*a*, formed on the switch body 1, and disposing a steel ball receiving base 14 forming a partition 14*a* in the middle part (first embodiment), or disposing a partition 1*d* on the other side of the wall face of the housing groove 1*a* (second embodiment) so as to keep the change in the urging force of the spring 10 for the steel ball at the time when the push buttons are pressed down in multiple steps.

While an interlocking device of a push-button switch according to the present invention has been explained above based on embodiments as applied to a two-stage push-button switch used for the operation of cranes and hoists, an interlocking device of a push-button switch according to the present invention can be widely applied to push-button switches other than those indicated in the embodiments, such as three-stage push-button switches, etc., for example.

What is claimed is:

1. An interlocking device for a push button switch, the push button switch including a switch body with fixed contacts, the push button switch having first and second push buttons which are downwardly movable in multiple stages by being pressed, each of the first and second push buttons having mobile contacts, said interlocking device comprising:

a first interlocking member having first and second end parts, a projection and a spindle, said first end part being inserted in the first push button, said second end part being inserted in the second push button, and said first interlocking member being swingably disposed on the switch body and being movable up and down through said spindle; and a second interlocking member having first and second end parts, a projection and a spindle, said second interlocking member being swingably disposed on the switch body through said spindle of said second interlocking member, wherein said projection of said second interlocking member is for contacting said projection of said first interlocking member.

2. The interlocking device as defined in claim 1, wherein only said first interlocking member swings when a push button is pressed down to a first stage of the multiple stages.

3. The interlocking device as defined in claim 1, wherein a spring for controlling the posture of said second interlocking member is provided between the push buttons and said second interlocking member.

4. The interlocking device as defined in claim 2, wherein a spring for controlling the posture of said second interlocking member is provided between the push buttons and said second interlocking member.

5. A push button switch comprising:

a switch body with fixed contacts;

first and second push buttons which are downwardly movable in multiple stages by being pressed, each of said first and second push buttons having mobile contacts;

an interlocking device comprising a first interlocking member having first and second end parts, a projection and a spindle, said first end part being inserted in said first push button, said second end part being inserted in said second push button, and said first interlocking member being swingably disposed on said switch body and being movable up and down through said spindle, and a second interlocking member having first and second end parts, a projection and a spindle, said second interlocking member being swingably disposed on said switch body through said spindle of said second interlocking member, wherein said projection of said second interlocking member is for contacting said projection of said first interlocking member.

6. The push button switch as defined in claim 5, wherein said first interlocking member is positioned on said switch body with said projection thereof facing down while said second interlocking member is positioned on said switch body with said projection thereof facing up, and only said first interlocking member swings when a push button is pressed down to a first stage of the multiple stages.

7. The push button switch as defined in claim 5, wherein a spring for controlling the posture of said second interlocking member is provided between said push buttons and said second interlocking member.

8. The push button switch as defined in claim 6, wherein a spring for controlling the posture of said second interlocking member is provided between said push buttons and said second interlocking member.

* * * * *